US009303344B2

(12) United States Patent
Kobayashi et al.

(10) Patent No.: US 9,303,344 B2
(45) **Date of Patent: *Apr. 5, 2016**

(54) SEWING MACHINE AND NON-TRANSITORY COMPUTER READABLE MEDIUM

(71) Applicant: BROTHER KOGYO KABUSHIKI KAISHA, Nagoya-shi, Aichi-ken (JP)

(72) Inventors: Harumi Kobayashi, Nagoya (JP); Midori Magara, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/482,967

(22) Filed: Sep. 10, 2014

(65) Prior Publication Data

US 2015/0090168 A1 Apr. 2, 2015

(30) Foreign Application Priority Data

Oct. 2, 2013 (JP) ..... 2013-207045

(51) Int. Cl.
*D05B 19/12* (2006.01)
*D05B 35/10* (2006.01)
*D05B 53/00* (2006.01)

(52) U.S. Cl.
CPC ..... *D05B 19/12* (2013.01); *D05B 35/102* (2013.01); *D05B 53/00* (2013.01)

(58) Field of Classification Search
CPC ..... D05B 35/102; D05B 21/00; D05B 3/06; D05B 29/06; G05B 2219/2626
USPC ..... 2/470.03, 470.06, 84, 65, 446, 273, 2/221, 235, 245; 700/136, 137
See application file for complete search history.

(56) References Cited

U.S. PATENT DOCUMENTS

| | | | | |
|---|---|---|---|---|
| 4,385,570 | A | 5/1983 | Yanagi | |
| 5,000,105 | A * | 3/1991 | Tanaka | D05B 35/102 112/153 |
| 5,941,187 | A * | 8/1999 | Rouleau | D05B 35/102 112/153 |
| 6,527,403 | B2 * | 3/2003 | Manuel | D05B 35/102 112/272 |
| 9,127,386 | B2 * | 9/2015 | Kobayashi | D05B 19/14 |
| 2005/0016428 | A1 | 1/2005 | Koerner | |

(Continued)

FOREIGN PATENT DOCUMENTS

| | | |
|---|---|---|
| JP | A-61-154594 | 7/1986 |
| JP | A-62-64390 | 3/1987 |

(Continued)

OTHER PUBLICATIONS

Pending U.S. Appl. No. 14/482,634, filed Sep. 10, 2014.

(Continued)

*Primary Examiner* — Tejash Patel
(74) *Attorney, Agent, or Firm* — Oliff PLC

(57) ABSTRACT

A sewing machine includes a bed, a needle plate, a needle bar, a needle bar swing mechanism, a lift mechanism, an optical detecting portion, and a control portion. The lift mechanism is configured to raise and lower a presser foot. The optical detecting portion is configured to optically detect a cord guided by the guide portion, and to output data representing the cord. The control portion is configured to calculate a width of the cord based on the data output by the optical detecting portion, calculate a height position of the presser foot based on the width of the cord, and cause the lift mechanism to move the presser foot to the height position.

20 Claims, 17 Drawing Sheets

(56) References Cited

U.S. PATENT DOCUMENTS

| | | | |
|---|---|---|---|
| 2007/0227420 | A1 | 10/2007 | Suzuki et al. |
| 2009/0194008 | A1 | 8/2009 | Hayakawa et al. |
| 2010/0224111 | A1 | 9/2010 | Ihira et al. |

FOREIGN PATENT DOCUMENTS

| | | |
|---|---|---|
| JP | A-5-228284 | 9/1993 |
| JP | A-8-311761 | 11/1996 |
| JP | A-2006-271799 | 10/2006 |
| JP | A-2009-172122 | 8/2009 |
| JP | A-2009-233435 | 10/2009 |

OTHER PUBLICATIONS

Feb. 13, 2015 Office Action issued in U.S. Appl. No. 14/482,634.

* cited by examiner

SEWING MACHINE AND NON-TRANSITORY COMPUTER READABLE MEDIUM

CROSS-REFERENCE TO RELATED APPLICATION

This application claims priority to Japanese Patent Application No. 2013-207045, filed on Oct. 2, 2013, the content of which is hereby incorporated herein by reference in its entirety.

BACKGROUND

The present disclosure relates to a sewing machine that is capable of sewing a cord onto a work cloth, and also relates to a non-transitory computer readable medium.

Sewing machines that are capable of sewing a cord onto a work cloth are known. A presser foot for cording, for example, is known as an element used when the sewing machine sews a cord onto the work cloth. A main body of the presser foot has a cord guide groove formed in a back face thereof. The guide groove extends in the front-rear direction. The cord may move along the guide groove toward the rear from the front together with the work cloth.

SUMMARY

When the cord sewing direction, i.e., the work cloth sewing direction, is turned 90 degrees, for example, the sewing machine needs to be once deactivated and then the presser foot needs to be removed from the work cloth and the cord. If the position of the lifted presser foot in the height direction is too low, the cord may be caught by the guide groove of the presser foot, and a user may not be able to turn the work cloth smoothly. On the other hand, when the position of the lifted presser foot is too high, the sewing machine needs more time to move the presser foot up and down.

Various embodiments of the broad principles derived herein provide a sewing machine that is capable of raising and lowering a presser foot to an appropriate height depending upon a thickness of a cord, and a non-transitory computer readable medium.

Various embodiments herein provide sewing machine that includes a bed, a needle plate, a needle bar, a needle bar swing mechanism, a lift mechanism, an optical detecting portion, and a control portion. The needle plate is provided on the bed and having a flat surface. The needle bar is configured to hold a sewing needle. The needle bar swing mechanism is configured to cause the needle bar to swing in a first direction. The lift mechanism is configured to raise and lower a presser foot. The presser foot includes a needle opening, a guide portion and a pressing face. The needle opening is configured to allow the sewing needle to pass through the needle opening. The guide portion is configured to guide a cord toward the needle opening along a second direction. The second direction is generally parallel to the flat surface of the needle plate and generally perpendicular to the first direction. The pressing face is configured to be arranged to face the flat surface of the needle plate and press the needle plate. The optical detecting portion is configured to optically detect the cord guided by the guide portion and to output data representing the cord. The control portion is configured to calculate a width of the cord based on the data output by the optical detecting portion, calculate a height position of the presser foot based on the width of the cord, and cause the lift mechanism to move the presser foot to the height position. The width of the cord is a length of the cord in a third direction. The third direction is generally parallel to the flat surface of the needle plate and generally perpendicular to an extending direction of the cord. The height position is a position of the pressing face relative to the flat surface in an up-down direction.

Various embodiments also provide a non-transitory computer readable medium configured to store computer readable instructions executable by a computer of a sewing machine. The sewing machine includes a bed, a needle plate provided on the bed and having a flat surface, a needle bar configured to hold a sewing needle, a needle bar swing mechanism configured to swing the needle bar in a first direction, and a lift mechanism configured to raise and lower a presser foot. The presser foot includes a needle opening, a guide portion, and a pressing face. The needle opening is configured to allow the sewing needle to pass through the needle opening. The guide portion is configured to guide a cord toward the needle opening along a second direction. The second direction is a direction generally parallel to the flat surface of the needle plate and generally perpendicular to the first direction. The pressing face is configured to be arranged to face the flat surface of the needle plate and press the needle plate. The computer readable instructions, when executed, cause the sewing machine to calculate a width of the cord based on data output by an optical detecting portion of the sewing machine, calculate a height position of the presser foot based on the width of the cord, and cause the lift mechanism to move the presser foot to the height position. The optical detecting portion is configured to optically detect the cord guided by the guide portion. The width of the cord is a length of the cord in a third direction. The third direction is generally parallel to the flat surface of the needle plate and generally perpendicular to an extending direction of the cord. The height position is a position of the pressing face relative to the flat surface in an up-down direction.

BRIEF DESCRIPTION OF THE DRAWINGS

Embodiments will be described below in detail with reference to the accompanying drawings in which.

DETAILED DESCRIPTION

Embodiments will be hereinafter described with reference to the drawings.

Figure 1:
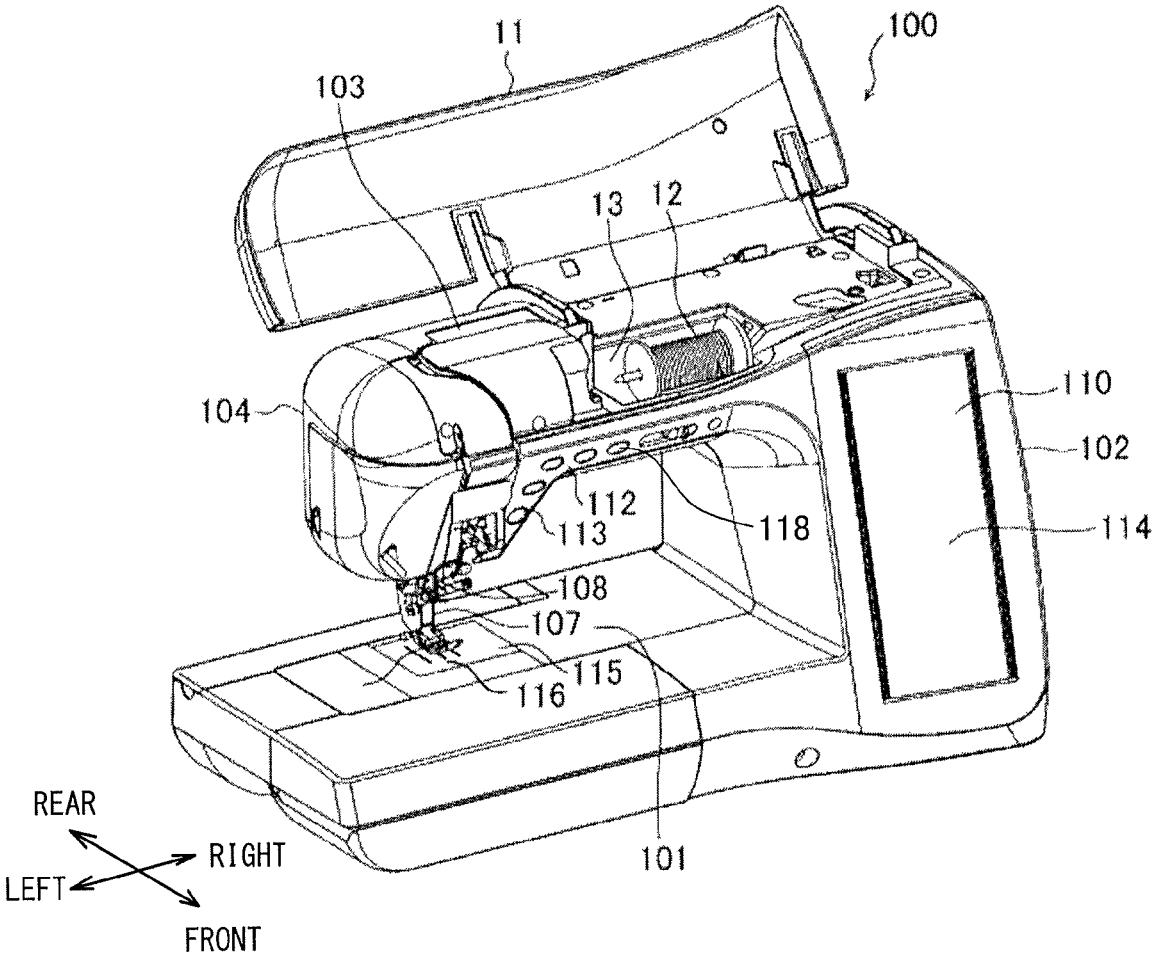
FIG. 1 is a perspective view of a sewing machine according to one embodiment.

Referring first to FIG. 1, a structure of a sewing machine 100 according to one embodiment will be described. The sewing machine 100 includes a bed 101, a pillar 102, an arm 103, and a head 104. The bed 101 is a base member of the sewing machine 100. The bed 101 has a flat surface on which a work cloth 99 (see FIG. 9) can be placed. A needle plate 115 is provided on the bed 101. The needle plate 115 has a flat surface 116. The pillar 102 extends from the bed 101. The arm 103 extends from the pillar 102 such that the arm 103 is opposed to the bed 101.

In the present embodiment, the directions are defined in the following manner. A direction perpendicular to the flat surface 116 of the needle plate 115 is the up-down direction. A direction that is parallel to the flat surface 116 of the needle plate 115 and coincides with a swinging direction of a needle bar 108 is the left-right direction. A direction that is parallel to the flat surface 116 of the needle plate 115 and is perpendicular to the swinging direction of the needle bar 108 is the front-rear direction.

A cloth feed mechanism, a horizontal rotary shuttle and the like are provided below the needle plate 115, i.e., in the bed 101. The cloth feed mechanism is configured to cause a feed dog to move up and down as well as frontward and rearward. The horizontal rotary shuttle is configured to house a lower thread bobbin, and is configured to form stitches in conjunction with a sewing needle 107 held by the needle bar 108.

A cover 11 is provided on an upper portion of the arm 103 such that the cover 11 can open and close. A housing portion 13 is formed in a front center portion of the arm 103 when the cover 11 is opened. The housing portion 13 is configured to house a thread spool 12. An upper thread from the thread spool 12 may be supplied to the sewing needle 107 through a plurality of thread setting paths including a thread take-up lever and the like.

A plurality of keys 112 are provided on a front face of the arm 103. The keys 112 include a start/stop key 113 and a presser foot lift key 118. Start and stop commands for the sewing operation of the sewing machine 100 may be entered via the start/stop key 113. Lift and lower commands for raising and lowering a presser foot 47C or 47 (see FIGS. 2 and 3) may be entered via the presser foot lift key 118.

A vertical liquid crystal display 110 is provided in a front face of the pillar 102. The liquid crystal display 110 is configured to display, for example, various stitch patterns, function names that may be used to perform various functions necessary for sewing, and various guidance messages. The stitch patterns include various stitches such as utility stitches and decorative stitches. The utility stitches may include, for example, a straight stitch and a zigzag stitch. The decorative stitches may include, for example, a pattern of a design that is made from a plurality of line segments appropriately combined to each other. The sewing machine 100 can sew any of the utility stitches and the decorative stitches, using the cloth feed mechanism to feed a cloth together with the needle bar swing mechanism 15 to swing the needle bar 108.

A touch panel (touch screen) 114 is provided on the front face of the liquid crystal display 110. The touch panel 114 has a plurality of touch keys. The touch panel 114 is transparent. A user can select a stitch pattern by pressing a touch key, which corresponds to a desired stitch pattern, among plural kinds of stitch patterns displayed on the liquid crystal display 110, with his finger. The user can instruct the execution of various functions that are needed for sewing, by pressing one or more touch keys, which correspond to the function names displayed on the liquid crystal display 100, with his finger.

Figure 2:
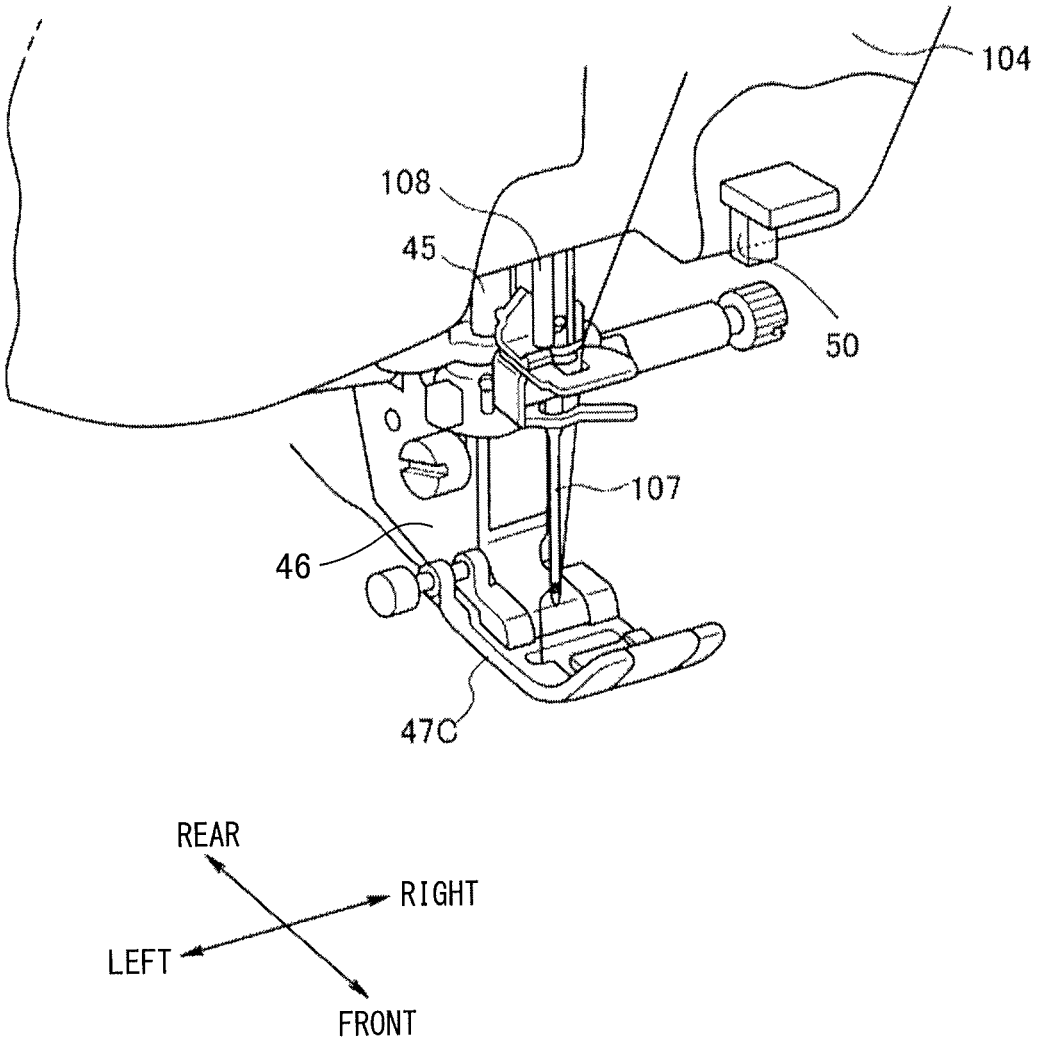
FIG. 2 is a perspective view of a head of the sewing machine.

Referring to FIG. 2, an image sensor 50 of the sewing machine 100 will be described. The image sensor 50 is mounted inside the head 104. The image sensor 50 is provided at a lower front portion of the head 104. Specifically, the image sensor 50 is provided at a position in a diagonally front and upper right direction when viewed from the presser foot 47C. The image sensor 50 may be, for example, a well-known CMOS image sensor that includes a CMOS sensor and a control circuit. It should be noted that the image sensor 50 may not be the CMOS image sensor but may be a well-known CCD image sensor. The image sensor 50 is configured to capture an image of a specified range from the diagonally upper right front position. When the presser foot 47C is attached to the sewing machine 100, the presser foot 47C is included in the specified range. The image sensor 50 is configured to convert incident light to an electric signal and to output the electric signal. The liquid crystal display 110 may display an image captured by the image sensor 50. The presser foot 47C shown in FIG. 2 is a presser foot for normal sewing. The user can remove the normal sewing presser foot 47C from the sewing machine 100, and attach a cording foot to the sewing machine 100. In the following description, the cording foot is referred to as the presser foot 47. The image sensor 50 is configured to optically detect the cord 41, which is pressed by the presser foot 47, and to output data representing a shape of the cord 41. Specifically, the image sensor 50 is configured to capture an image of the cord 41 pressed by the presser foot 47, and to output data representing an image of the presser foot 47 which includes the cord 41, as the data representing the shape of the cord 41.

As shown in FIG. 2, the needle bar 108 and the presser bar 45 extend downward from a lower portion of the head 104. The needle bar 108 is configured to hold the sewing needle 107. Specifically, the sewing needle 107 may be secured to a lower end of the needle bar 108. A needle bar up-down mechanism is provided inside the head 104. The needle bar up-down mechanism is configured to be driven by rotation of a drive shaft motor 79. The needle bar 108 may be driven to move up and down by the needle bar up-down mechanism. The presser foot 47C is configured to be attached to a lower end of the presser bar 45, via a presser foot holder 46, for example. The presser foot 47C is configured to press the work cloth 99 (see FIG. 9) down.

Figure 3:
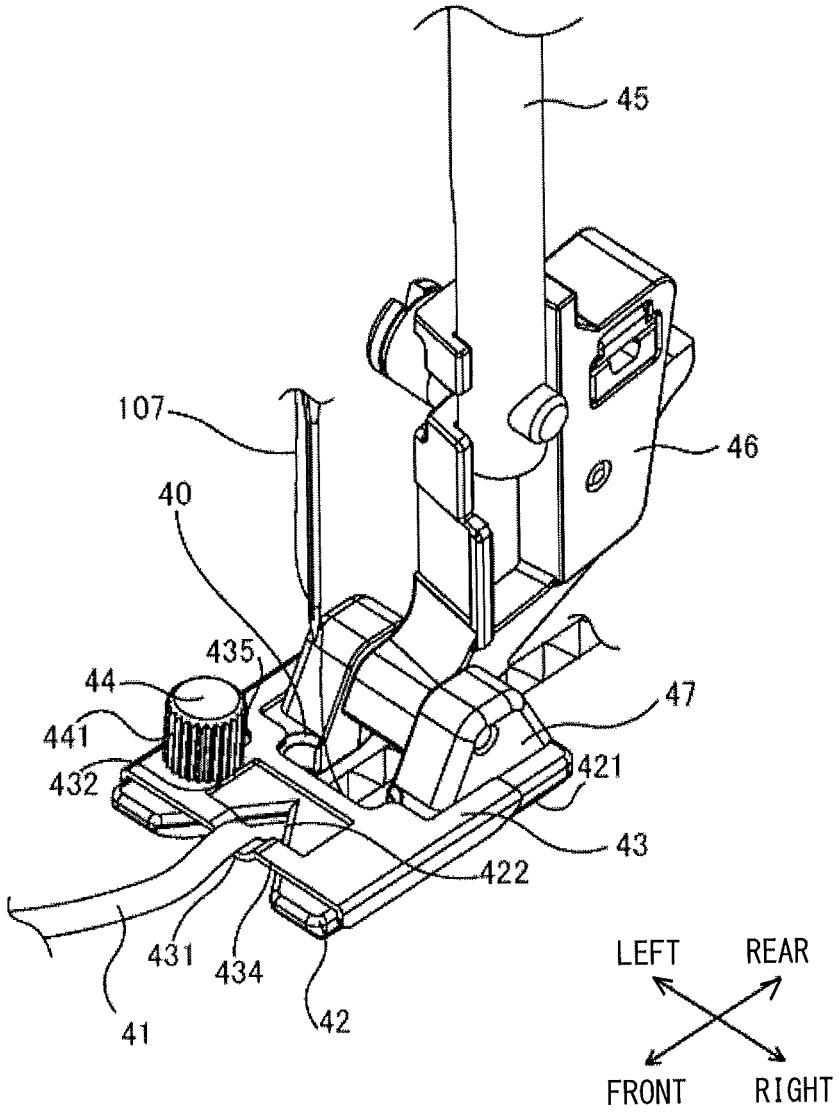
FIG. 3 is a perspective view of a presser foot.

Referring to FIG. 3, the presser foot 47, which is the cording foot, will be described. The presser bar 45 extends in the up-down direction. The presser foot holder 46 may be secured to a lower end of the presser bar 45. The presser foot holder 46 is configured to detachably hold the presser foot 47. The presser foot 47 includes a presser foot main body 42, a guide plate 43, and a screw 44.

Figure 9:
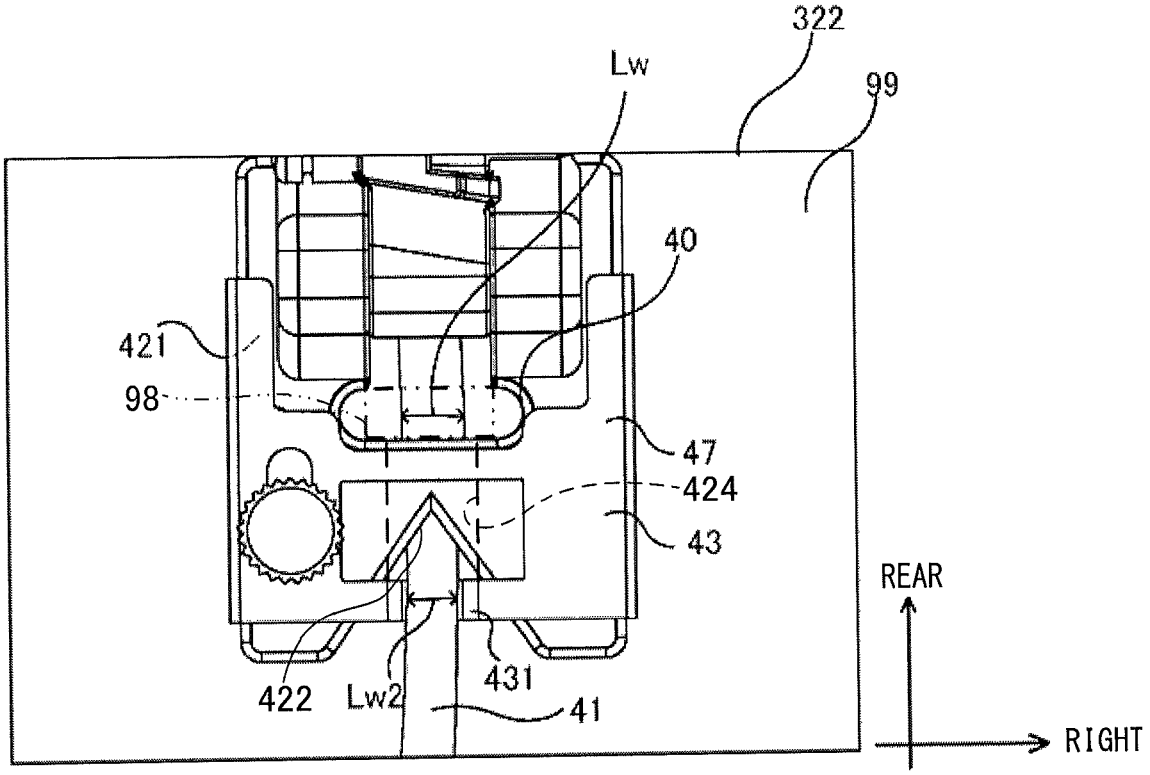
FIG. 9 illustrates an example of a cord-present image.

The presser foot main body 42 has a pressing face 421. The pressing face 421 is a face that is configured to be arranged to face the flat surface 116 of the needle plate 115 (see FIG. 1), and that is configured to press the work cloth 99 (see FIG. 9) down. The presser foot main body 42 has an oval needle opening 40 formed at the center portion of the presser foot main body 42 in the front-rear direction. The oval needle opening 40 is elongated in the left-right direction. The needle opening 40 opens above a through hole 73 (see FIG. 16) formed in the needle plate 115. The through hole 73 has an oval shape elongated in the left-right direction. The sewing needle 107 may be moved up and down through the needle opening 40 and the through hole 73. A cut-out portion 422 is formed in the front edge of the presser foot main body 42. The cut-out portion 422 has an inverted "V" shape when viewed from the top. The cord 41 may be put between the cut-out portion 422 and a crossbeam 434 of the guide plate 43, which will be described later, and may be guided toward the needle opening 40. On the left side of the cut-out portion 422 of the presser foot main body 42, there is provided a screw hole (not shown) that is configured to engage with a male-screw portion of the screw 44. As shown in FIG. 9, the presser foot main body 42 has a guide groove 424 that is recessed upward from the pressing face 421. The guide groove 424 is formed in the center portion, in the left-right direction, of the pressing face 421, and extends in the front-rear direction from the cut-out portion 422 to the needle opening 40. The guide groove 424 is configured to guide the cord 41 toward the needle opening 40. The guide groove 424 is configured to press the cord 41 against the work cloth 99 or against the needle plate 115.

The guide plate 43 is attached on the upper side of the presser foot main body 42. A rectangular hole 432 is formed in a front portion of the guide plate 43. The hole 432 has a rectangular shape when viewed from the top. The crossbeam 434 is a portion of the guide plate 43 which extends in the left-right direction along the front side of the rectangular hole 432. A concaved portion 431 is formed in a center portion, in the left-right direction, of the crossbeam 434. The concaved portion 431 is concaved downward relative to the flat plane defined by the guide plate 43. The cord 41 may be placed on the upper surface of the concaved portion 431 and put through the rectangular hole 432 downward. An oval hole 435 that is elongated in the front-rear direction is formed on the left side of the rectangular hole 432. The oval hole 435 is positioned above the screw hole of the presser foot main body 42. The male-screw portion (not shown) of the screw 44 is inserted through the oval hole 435 and screwed into the screw hole (not shown) of the presser foot main body 42. The concaved portion 431 of the guide plate 43 and the guide groove 424 of the presser foot main body 42 are configured to guide the cord 41 in the front-rear direction toward the needle opening 40 and in parallel to the flat surface 116 of the needle plate 115.

The screw 44 has a post-like head 441 and the male-screw portion (not shown). The head 441 has a straight knurl on its lateral face such that a user can easily hold the head 441 with his fingers. The male-screw portion extends downward from a lower end of the head 441. The male-screw portion extends through the oval hole 435 and is screwed into the screw hole of the presser foot main body 42. As the user unscrews the screw 44, the guide plate 43 is able to slide in the front-rear direction. Thus, the user can adjust the position of the guide plate 43 relative to the presser foot main body 42 in the front-rear direction, depending upon the thickness of the cord 41.

How the user sets the cord 41 in the presser foot 47 will be described. The user unscrews the screw 44 and slides the guide plate 43 forward. The user places the cord 41 over the concaved portion 431 of the guide plate 43, and puts the cord 41 through the rectangular hole 432 and under the cut-out portion 422 of the presser foot main body 42. Then, the user moves the cord 41 to the needle opening 40 along the guide groove 424 (see FIG. 9). The user appropriately slides the guide plate 43 backward such that the cord 41 is slightly clamped between the crossbeam 434 and the cut-out portion 422. The user tightens the screw 44 to fix the position of the guide plate 43. In this manner, the user can set the cord 41 in the presser foot 47.

Figure 4:
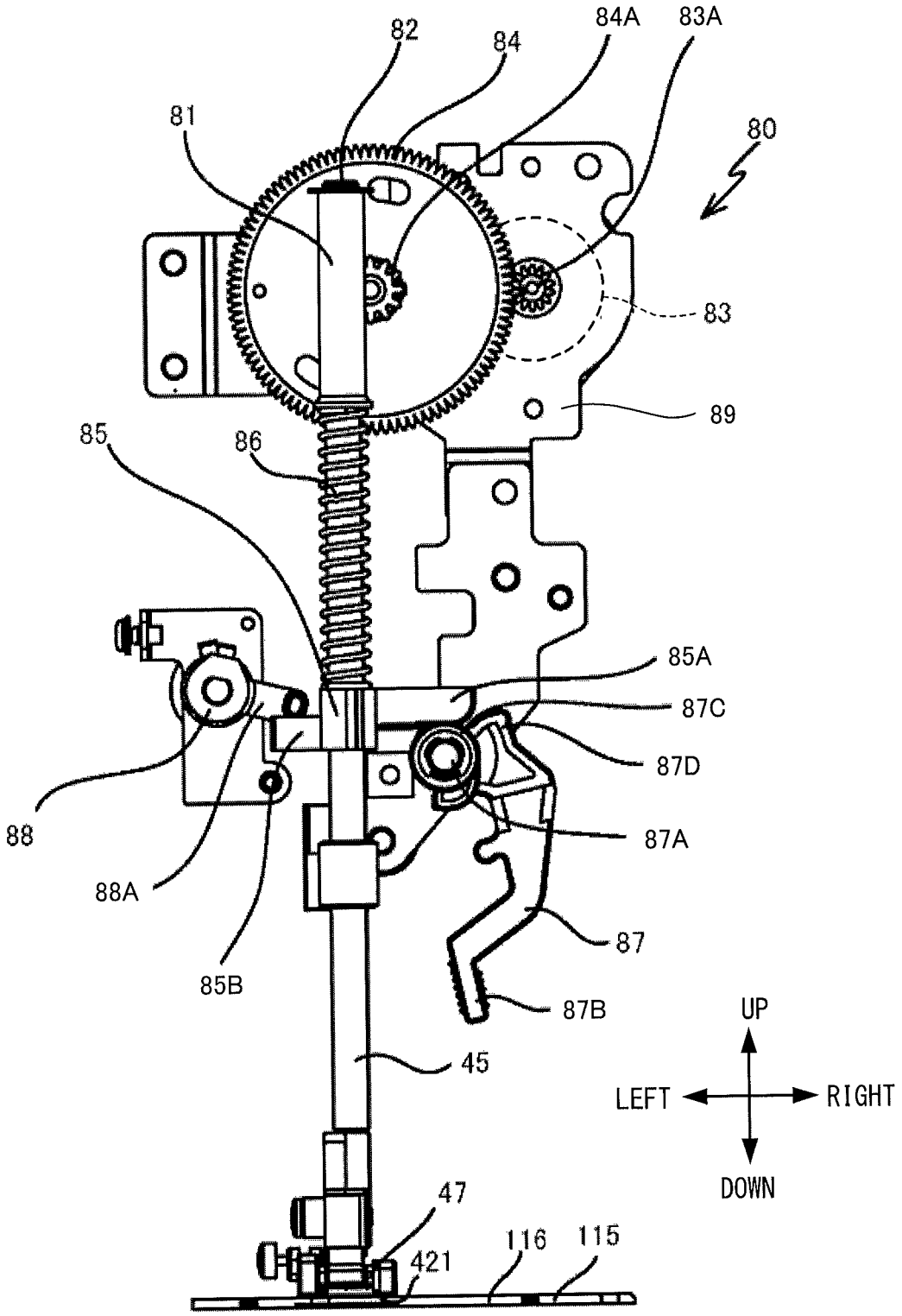
FIG. 4 is a front view of view of a lift mechanism.

Referring to FIG. 4, a lift mechanism 80 for raising and lowering the presser foot 47 will be described.

The presser bar 45 is arranged behind the needle bar 108. A machine frame of the sewing machine 100 supports the presser bar 45 such that the presser bar 45 can move up and down. The presser foot 47 may be attached to the lower end of the presser bar 45 via the presser foot holder 46.

The lift mechanism 80 includes a rack member 81, a retaining ring 82, a lift motor 83, a drive gear 83A, an intermediate gear 84, a pinion 84A, a presser bar clamp 85, a presser spring 86, a presser lift lever 87, and a potentiometer 88. The rack member 81 is fitted over an upper end of the presser bar 45 such that the rack member 81 can move up and down. The retaining ring 82 is fixed to an upper end of the presser bar 45. The presser bar clamp 85 is fixed to a center portion, in the height direction, of the presser bar 45. The presser spring 86 is fitted over the presser bar 45 between the rack member 81 and the presser bar clamp 85. A mounting plate 89 is fixed to the machine frame. The lift motor 83 for moving the presser bar 45 up and down is fixed to the machine frame on the right side of the rack member 81 and behind the mounting plate 89. The drive gear 83A couples to an output shaft of the lift motor 83 in front of the mounting plate 89. The intermediate gear 84 meshes with the drive gear 83A. The pinion 84A is formed integrally with the intermediate gear 84. The pinion 84A meshes with the rack member 81. The presser lift lever 87 is configured to move the presser bar 45 up and down, which is independent of the up and down movements of the presser bar 45 by the lift motor 83. The potentiometer 88 is provided on the left side of the presser bar 45, and is configured to detect the position of the presser foot 47 in the height direction (height position of the presser foot 47).

The potentiometer 88 is a rotary potentiometer. The potentiometer 88 is configured to detect the height position of the presser bar 45. A shaft portion 88A extends to the right from a rotating shaft of the potentiometer 88. A projecting portion 85B protrudes to the left of the presser bar clamp 85. The shaft portion 88A abuts on an upper face of the projecting portion 85B. The shaft portion 88A rotates as the presser bar clamp 85 moves up and down. As the shaft portion 88A rotates, a resistance value of the potentiometer 88 changes. The potentiometer 88 is configured to output a voltage that corresponds to the resistance value. A CPU 61, which will be described later (see FIG. 6), is configured to detect the height position of the presser bar 45 based on the voltage output by the potentiometer 88. Therefore, the CPU 61 can identify the thickness of the work cloth 99 based on the voltage output by the potentiometer 88 while the work cloth 99 is being clamped between the presser foot 47 and the needle plate 115.

A support pin 87A rotatably supports one end of the presser lift lever 87 at the mounting plate 89. An operation portion 87B is provided at the other end of the presser lift lever 87. When a user moves the operation portion 87B manually such that the operation portion 87B rotates upward or downward, the presser bar 45 and the presser foot 47 move up or down. In the present embodiment, however, an example will be described in which the user does not move the operation portion 87B, but the activated lift motor 83 moves the presser bar 45 and the presser foot 47 up and down, as will be described later.

The presser lift lever 87 has a boss surface 87C, which is coaxial with the support pin 87A, and an inclined cam surface 87D. A cam follower 85A is integral with the presser bar clamp 85 and protrudes to the right. The cam surface 87D may abut on the cam follower 85A when the user rotates the operation portion 87B upward. When the presser lift lever 87 and the presser foot 47 are at a lowered position, there is a small gap between the boss surface 87C and the cam follower 85A in the up-down direction.

The upward and downward movements of the presser bar 45 and the presser foot 47 by the lift mechanism 80 will be described. As the lift motor 83 is driven, the lift mechanism 80 is driven. A driving force of the lift motor 83 is transmitted to the drive gear 83A, the intermediate gear 84, the pinion 84A, and the rack member 81 to move the rack member 81 upward and downward. The presser spring 86 and the retaining ring 82 cause the presser bar 45 to move upward and downward together with the rack member 81. As the presser bar 45 moves upward and downward, the presser foot 47 moves to at least the lowered position and a raised position. The lowered position is a position at which the pressing face 421 of the presser foot 47 abuts on the flat surface 116 of the needle plate 115, as shown in FIG. 4. The raised position is a height position at which the pressing face 421 of the presser foot 47 contacts an upper end 415 of the cord 41 (see FIG. 13), and the work cloth 99 and the cord 41 can move between the presser foot 47 and the needle plate 115.

Figure 5:
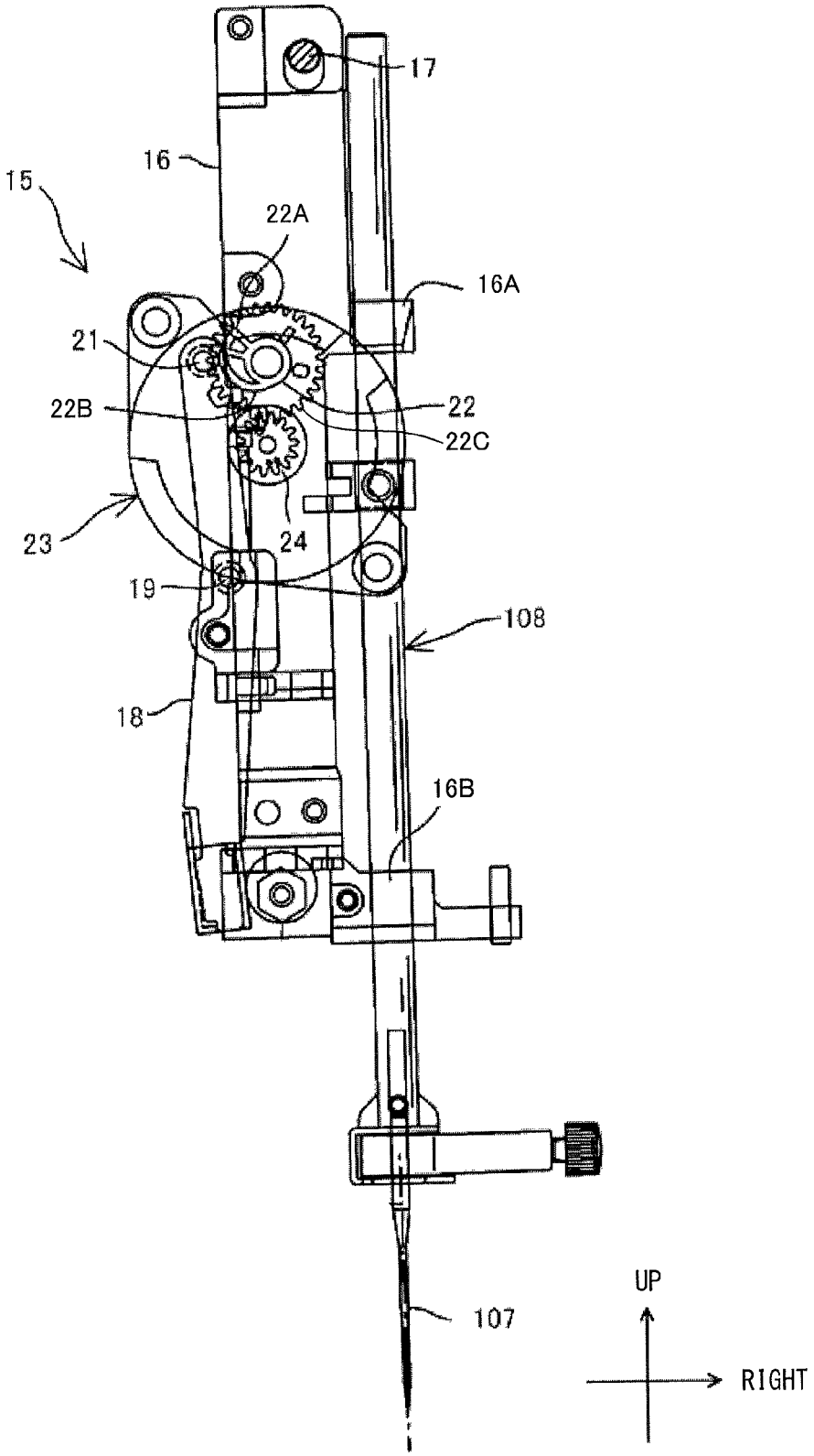
FIG. 5 illustrates a front view of a needle bar swing mechanism.

Referring to FIG. 5, the needle bar swing mechanism 15 will be described. The needle bar swing mechanism 15 includes a needle bar support 16, a swing lever 18, a swing motor 23, and a swing cam 22. The needle bar swing mechanism 15 is configured to cause the needle bar 108 to swing.

The needle bar support 16 is elongated in the up-down direction. The needle bar support 16 extends in parallel to the extending direction of the needle bar 108, and is disposed adjacent to the needle bar 108. An upper end portion of the needle bar support 16 is swingably supported by the machine frame of the sewing machine 100 at a support shaft 17. The needle bar support 16 has two support portions, i.e., an upper support portion 16A and a lower support portion 16B. The upper support portion 16A and the lower support portion 16B support, in combination, the needle bar 108 such that the needle bar 108 can move in the up-down direction. Therefore, the needle bar 108 is able to be moved in the up-down direction, and swung in the left-right direction in response to the swinging movement of the needle bar support 16.

The swing lever 18 extends vertically. The swing lever 18 is located opposite the needle bar 108 over the needle bar support 16. The swing lever 18 is swingably supported by a support pin 19 at an approximate center, in the up-down direction, of the needle bar support 18. The support pin 19 is fixedly secured to the machine frame of the sewing machine 100. A lower end portion of the swing lever 18 abuts on a lower end portion of the needle bar support 16. An abutment pin 21 is fixedly secured to an upper end portion of the swing lever 18.

The swing cam 22 is situated behind the needle bar support 16. The swing cam 22 has a gear portion 22C that meshes with a drive gear 24 fixedly secured to the drive shaft of the swing motor 23. The swing motor 23 is configured to cause the swing cam 22 to rotate via the drive gear 24 clockwise or counterclockwise.

A curved cam surface is formed on the swing cam 22. The cam surface is defined by a shape that smoothly joins a radially expanded cam 22A with a radially reduced cam 22B. The distance to the radially expanded cam 22A from the rotation axis is greater than the distance to the radially reduced cam 22B from the rotation axis. The needle bar support 16 is biased to the left at the lower end portion of the needle bar support 16 by a coil spring (not shown). As the needle bar support 16 is biased to the left, the abutment pin 21 of the swing lever 18 is biased to the right, and always abuts on the cam surface of the swing cam 22.

How the needle bar 108 is caused to swing will be described. When the swing cam 22 rotates clockwise along with rotation of the swing motor 23, and the abutment pin 21 abuts on the radially reduced cam 22B, the upper end portion of the swing lever 18 moves to the right. As the upper end portion of the swing lever 18 moves to the right, the lower end portion of the swing lever 18 moves to the left. Because the lower end portion of the swing lever 18 moves to the left, the needle bar support 16 and the needle bar 108 are caused to move to the left by the biasing force of the coil spring. The needle drop point of the sewing needle 107 when the needle bar 108 moves to the left is referred to as a left baseline position.

When the swing cam 22 rotates counterclockwise along with rotation of the swing motor 23, and the abutment pin 21 abuts on the radially expanded cam 22A, the upper end portion of the swing lever 18 moves to the left. As the upper end portion of the swing lever 18 moves to the left, the lower end portion of the swing lever 18 moves to the right. Because the lower end portion of the swing lever 18 moves to the right, the needle bar support 16 and the needle bar 108 are caused to move to the right, against the biasing force of the coil spring. The needle drop point of the sewing needle 107 when the needle bar 108 moves to the right is referred to as a right baseline position. An intermediate position between the left baseline position and the right baseline position is referred to as a center baseline position.

In the present embodiment, a swing width (amplitude) of the sewing needle 107 from the left baseline position to the right baseline position is 7 millimeters. Therefore, the swing width of the sewing needle 107 from the left baseline position to the center baseline position is 3.5 millimeters, and the swing width of the sewing needle 107 from the center baseline position to the right baseline position is also 3.5 millimeters.

Figure 6:
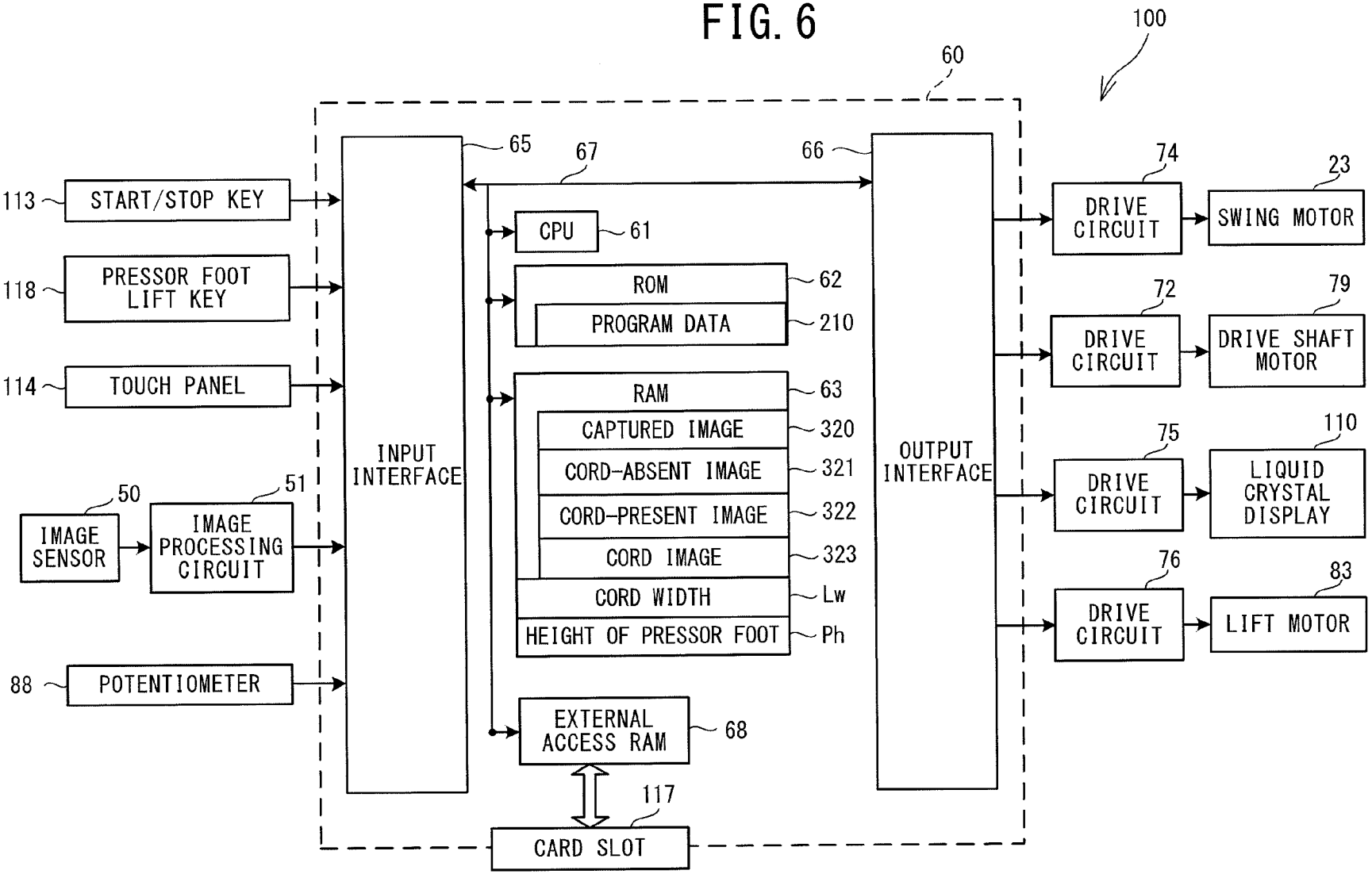
FIG. 6 illustrates a block diagram of an electrical configuration of the sewing machine.

Referring to FIG. 6, an electric configuration of the sewing machine 100 will be described. The control portion 60 of the sewing machine 100 includes the CPU 61, a ROM 62, a RAM 63, a card slot 117, an external access RAM 68, an input interface 65, and an output interface 66. These components of the control portion 60 are connected to each other by a bus 67. The start/stop key 113, the presser foot lift key 118, the touch panel 114, the potentiometer 88 and an image processing circuit 51 are connected to the input interface 65. The image processing circuit 51 is electrically connected to the image sensor 50. The image processing circuit 51 is configured to generate image data based on the electric signals output from the image sensor 50. Drive circuits 72, 74, 75 and 76 are electrically connected to the output interface 66. The drive circuit 72 is configured to drive the drive shaft motor 79. The drive circuit 74 is configured to drive the swing motor 23. The drive circuit 75 is configured to drive the liquid crystal display 110. The drive circuit 76 is configured to drive the lift motor 83.

The CPU 61 is a master controller for the sewing machine 100. The ROM 62, which is a read only storage element, is configured to store program data 210. The CPU 61 may perform various calculations, operations and processing in accordance with the program data 210 stored in the ROM 62. The program data 210 includes a program for cording processing, which will be described later. The RAM 63 is a storage element that is arbitrarily readable and writable. The RAM 63 is configured to store results of calculations and operations performed by the CPU 61 and other data. For example, the RAM 63 may store image data of the captured image 320, image data of a cord image 323, data representing a width Lw of the cord, and data representing a height Ph of the presser foot 47. The captured image 320 is an image captured by the image sensor 50. The captured image 320 may include a cord-absent image 321 and a cord-present image 322. The cord-absent image 321 is an image of the presser foot 47 when the cord 41 is not set in the presser foot 47. The cord-present image 322 is an image of the presser foot 47 when the cord 41 is set in the presser foot 47. The cord image 323 is an image that is generated from the cord-absent image 321 and the cord-present image 322 and that only shows the cord 41. The width Lw of the cord 41 and the height Ph of the presser foot 47 will be described later.

Figure 7:
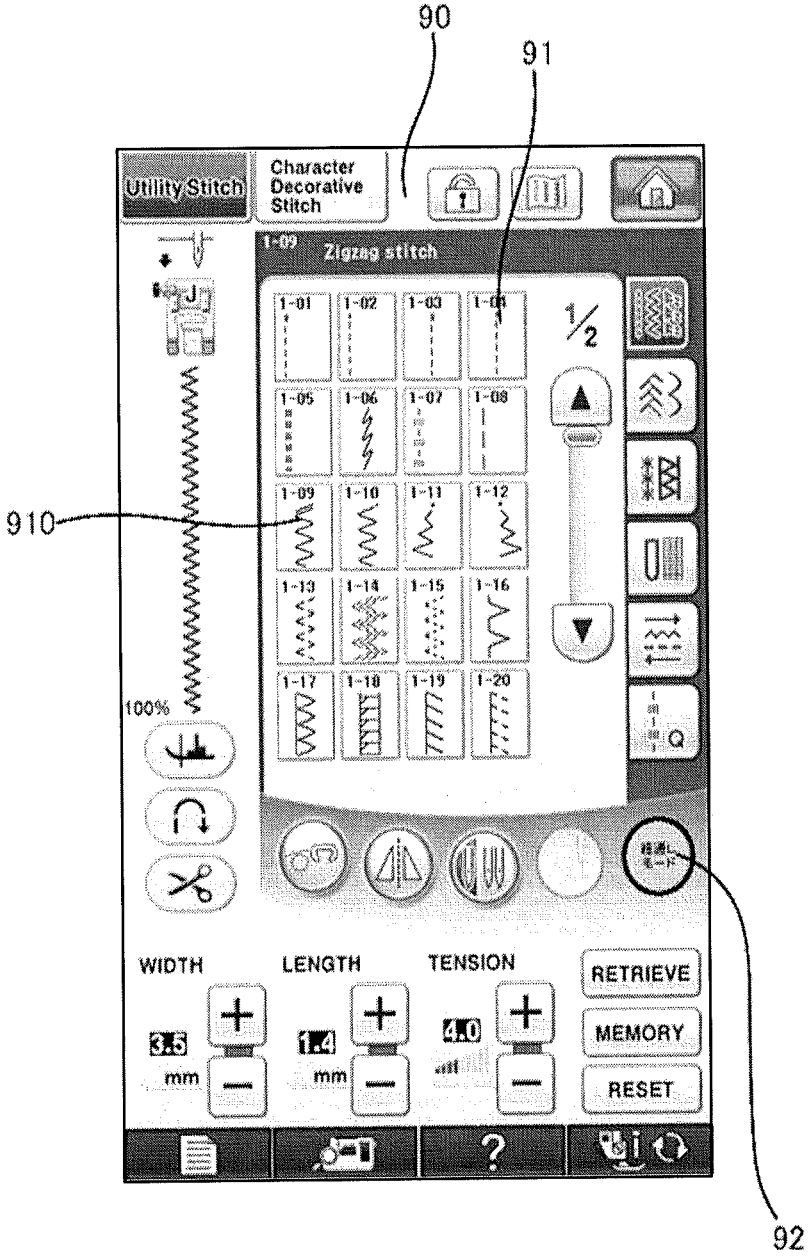
FIG. 7 illustrates an example of a cording mode selection screen.
Figure 8:
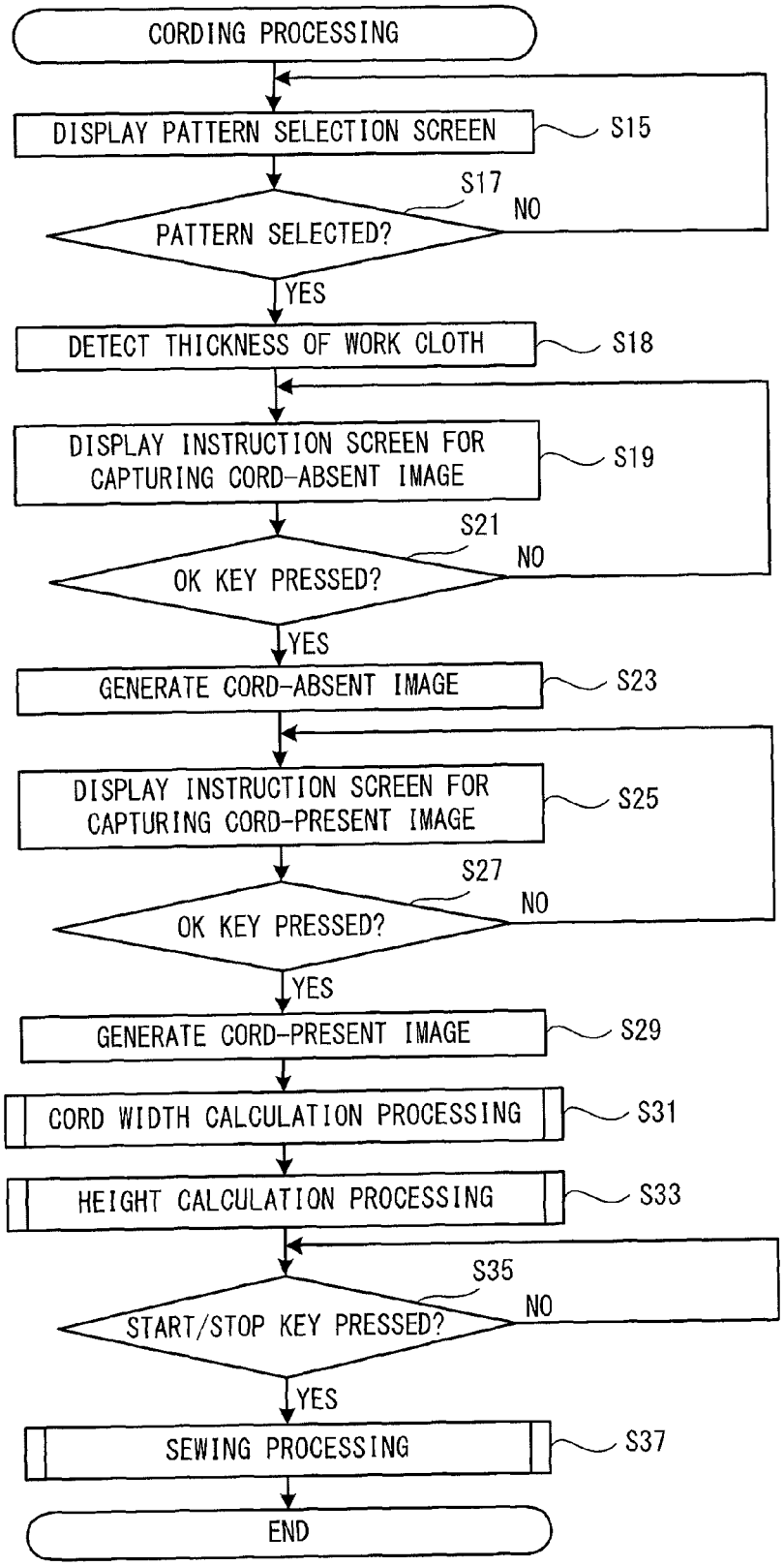
FIG. 8 illustrates a flowchart of cording processing.

Referring to FIG. 7 to FIG. 14, the cording processing will be described. The cording processing may be executed by the CPU 61 of the sewing machine 100 in accordance with the program data 210 stored in the ROM 62. When the user depresses a power button of the sewing machine 100, electricity is supplied to the sewing machine 100. When the electricity is supplied to the sewing machine 100, the CPU 61 controls the drive circuit 75 to cause the liquid crystal display 110 to display a cording mode selection screen 90. An example of the cording mode selection screen 90 is shown in FIG. 7. The cording mode selection screen 90 may include, for example, a plurality of stitch patterns 91 and a cording mode key 92. The user can select a desired stitch pattern from the stitch patterns 91. When the user touches a position on the touch panel 114 which corresponds to the cording mode key 92 with his finger, the CPU 61 reads the program for the cording processing from the ROM 62, and executes the cording processing shown in FIG. 8. The respective steps in the illustrated flowchart, which are referred to in the following description, indicate the processing performed by the CPU 61. At this time, the user causes the work cloth 99 to be clamped between the pressing face 421 of the presser foot 47 and the needle plate 115. Specifically, the user puts the work cloth 99 on the needle plate 115, and enters a command in the sewing machine 100 via the presser foot lift key 118 to lower the presser foot 47. Upon receiving the command for lowering the presser foot 47, the CPU 61 drives the lift motor 83 via the drive circuit 76. As the lift motor 83 is driven, the lift mechanism 80 moves the presser foot 47, from an initial position at which the presser foot 47 is positioned when the sewing machine 100 is powered on, to a position at which the pressing face 421 abuts on the upper face of the work cloth 99. Therefore, the pressing face 421 is situated above the flat surface 116 of the needle plate 115 by the thickness of the work cloth 99.

At Step S15, the CPU 61 causes the liquid crystal display 110 to display a pattern selection screen. Specifically, the CPU 61 sends a control signal to the liquid crystal display 110 via the drive circuit 75 to display the pattern selection screen. In accordance with the control signal from the CPU 61, the liquid crystal display 110 displays the pattern selection screen. More specifically, the CPU 61 reads image information representing the pattern selection screen from the ROM 62, and sends the image signal to the liquid crystal display 110. For example, the pattern selection screen may be the same as the cording mode selection screen 90 shown in FIG. 7, except for those stitch patterns which are unsuitable for the cording being displayed in the grayout state. The stitch patterns unsuitable for the cording may include, for example, a straight stitch. In a case where the stitch patterns unsuitable for the cording are displayed in the grayout state, the user does not accidentally select a stitch pattern unsuitable for the cording.

At Step S17, the CPU 61 determines whether a stitch pattern is selected or not. In a case where the CPU 61 determines that the stitch pattern is selected (S17: YES), the CPU 61 proceeds to Step S19. In a case where the CPU 61 determines that no stitch pattern is selected (S17: NO), the CPU 61 returns to Step S15. For example, if the user selects a zigzag pattern 910, the CPU 61 proceeds to Step S18.

At Step S18, the CPU 61 sends a control signal to the potentiometer 88 to instruct the detection of the thickness Lc of the work cloth 99. In response to the control signal from the CPU 61, the potentiometer 88 outputs a voltage that corresponds to the thickness Lc of the work cloth 99. The CPU 61 causes the RAM 63 to store data representing the thickness Lc of the work cloth 99 which is identified based on the output voltage.

At Step S19, the CPU 61 causes the liquid crystal display 110 to display an instruction screen for capturing a cord-absent image. The instruction screen for capturing the cord-absent image may be a screen that displays on the liquid crystal display 110 a window containing, for example, a message "The width of the cord to be sewn will be measured. An image of the presser foot without the cord will be taken." The window contains an OK key to instruct the capturing of an image of the presser foot 47 with no cord 41 being set. Specifically, the CPU 61 sends a control signal to the liquid crystal display 110 via the drive circuit 75 to display the instruction screen for capturing the cord-absent image. In response to the control signal from the CPU 61, the liquid crystal display 110 displays the instruction screen for capturing the cord-absent image.

At Step S21, the CPU 61 determines whether the OK key on the instruction screen for capturing the cord-absent image is pressed or not. In a case where the CPU 61 determines that the OK key is pressed (S21: YES), the CPU 61 proceeds to Step S23. In a case where the CPU 61 determines that the OK key is not pressed (S21: NO), the CPU 61 returns to Step S19.

At Step S23, the CPU 61 instructs, via the image processing circuit 51, the image sensor 50 to capture an image. In response to the image capture command, the image sensor 50 captures an image of the specified range including the presser foot 47. The image sensor 50 captures the image of the specified range from the obliquely right front of the presser foot 47, and outputs data representing the captured image 320. The CPU 61 converts the captured image 320 to a virtual image which would be obtained when an image of the specified range were captured from directly above. The converting method may be a method disclosed in Japanese Patent Application Laid-Open No. 2009-172122, relevant portions of which are incorporated herein by reference. The CPU 61 causes the RAM 62 to store the image data of the virtual image, which is obtained at Step S23, as image data of the cord-absent image 321.

At Step S25, the CPU 61 causes the liquid crystal display 110 to display an instruction screen for capturing the cord-present image. The instruction screen for capturing the cord-present image may be a screen that displays on the liquid crystal display 110 a window containing, for example, a message "The width of the cord to be sewn will be measured. An image of the presser foot with the cord set will be taken." The window contains an OK key to instruct the capturing of the image of the presser foot 47 with the cord 41 being set. Specifically, the CPU 61 sends a control signal to the liquid crystal display 110 via the drive circuit 75 to display the instruction screen for capturing the cord-present image. In response to the control signal from the CPU 61, the liquid crystal display 110 displays the instruction screen for capturing the cord-present image.

At Step S27, the CPU 61 determines whether the OK key on the instruction screen for capturing the cord-present image is pressed or not. In a case where the CPU 61 determines that the OK key is pressed (S27: YES), the CPU 61 proceeds to Step S29. In a case where the CPU 61 determines that the OK key is not pressed (S27: NO), the CPU 61 returns to Step S25.

At Step S29, the CPU 61 instructs the image sensor 50 to capture an image. In response to the image capture command, the image sensor 50 captures an image of the specified range including the presser foot 47 and the cord 41 pressed by the presser foot 47, and outputs data representing the captured image 320. Similar to the processing at Step S23, the CPU 61 converts the captured image 320 to a virtual image. The CPU 61 causes the RAM 62 to store the image data of the virtual image, which is obtained at Step S29, as image data of the cord-present image 322.

Referring to FIG. 9, the cord-present image 322 will be described. The cord 41 is located on the work cloth 99. In a case where the cord 41 is hard enough not to be deformed by the pressing force of the presser foot 47, the width Lw is substantially equal to the width Lw2. The width Lw is a width, in the left-right direction, of a portion of the cord 41 which is present in the needle opening 40. In other words, the width Lw is a length of the portion of the cord 41 which is present in the needle opening 40, in a direction parallel to the flat surface 116 of the needle plate 115 and perpendicular to the extending direction of the cord 41. The width Lw2 is a width, in the left-right direction, of a portion of the cord 41 which is placed on the concaved portion 431 of the guide plate 43.

At Step S31, the CPU 61 performs cord width calculation processing. The cord width calculation processing is processing in which the CPU 61 calculates the width Lw of the cord 41 based on the data representing the shape of the cord 41 (more specifically, based on the image data of the cord-absent image 321 and the cord-present image 322), which is output from the image sensor 50.

Figure 10:
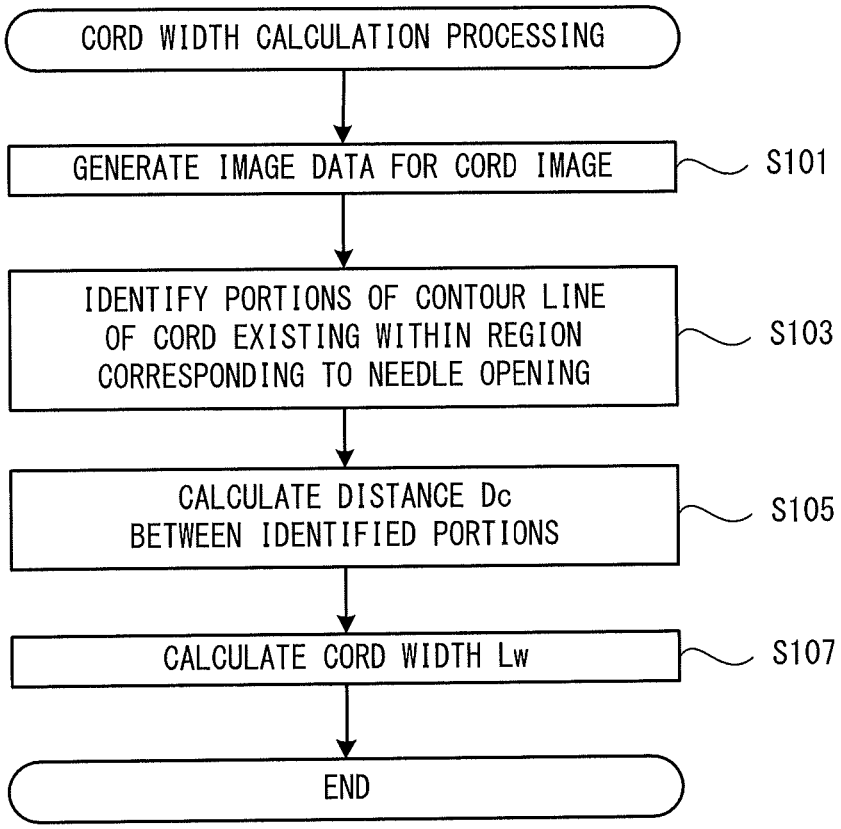
FIG. 10 illustrates a flowchart of cord width calculation processing.
Figure 11:
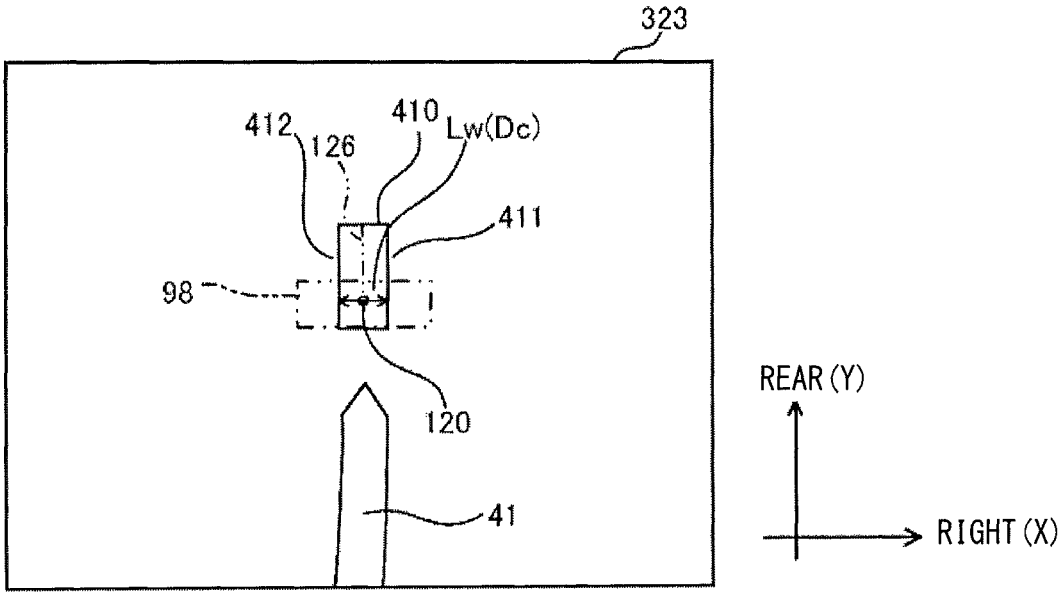
FIG. 11 illustrates an example of a cord image.

Referring to FIGS. 10 and 11, the cord width calculation processing (Step S31 in FIG. 8) will be described in detail. As the processing of Step S31 starts, the CPU 61 proceeds to Step S101 shown in FIG. 10.

At Step S101, the CPU 61 generates image data of the cord image 323 from the image data of the cord-absent image 321 and the image data of the cord-present image 322 stored in the RAM 63. The cord-absent image 321 and the cord-present image 322 are obtained by capturing images of the same specified range that includes the presser foot 47. The CPU 61 subtracts brightness and color information of the respective pixels of the image data of the cord-absent image 321 from brightness and color information of the respective pixels of the image data of the cord-present image 322. The color information is, for example, RGB values. In such a manner, the CPU 61 generates image data of the cord image 323. An example of the cord image 323 is illustrated in FIG. 11. The cord image 323 is an image of the specified range that does not include the presser foot 47 and includes the cord 41 only.

At Step S103, the CPU 61 extracts a contour line 410 of the cord 41 from the cord image 323, which is shown in FIG. 11, by means of image processing, and then identifies portions of the contour line 410 which exist in an area 98 that corresponds to an inside of the needle opening 40. One example of the image processing to be employed here may be an edge detection. Specifically, the CPU 61 applies a well-known Hough transformation on the cord image 323. The CPU 61 applies a Sobel filtering processing on the Hough-transformed image to produce an edge intensity image. The edge is a portion at which an image intensity value sharply changes. The CPU 61 binarizes the edge intensity image to produce an image of a sequence of edge points. The CPU 61 applies the Hough transformation on the image of the sequence of edge points to produce a Hough-transformed image. The CPU 61 applies a non-maximum suppression processing on the Hough-transformed image to extract locally bright points in the Hough-transformed image. Out of the extracted bright points, the CPU 61 further extracts those bright points which are brighter than a specified threshold. The CPU 61 applies an inverse Hough transformation on the extracted bright points to extract straight lines as the contour line 410. The contour line 410 includes two contour lines 411 and 412 of the cord 41 which are opposed to each other in the swing direction of the needle bar 108. In the present embodiment, the image sensor 50 does not have a capability of changing an image capture direction and a magnification. Thus, both of the cord-absent image 321 and the cord-present image 322 are images which are obtained by capturing images of the same specified range. As such, the area 98 corresponding to the inside of the needle opening 40 can be defined by specified coordinates in the cord image 323. The specified coordinates may be stored beforehand in the ROM 62. The specified coordinates may be, for example, (−5, 3), (−5, −3), (5, −3) and (5, 3) in the X and Y direction coordinates as shown in FIG. 11. The coordinates of the origin are (0, 0) and coincide with the needle drop point 120 on the center baseline 126. Therefore, the CPU 61 can identify those portions of the extracted contour line 410 which exist in the area 98, based on the specified coordinates.

The portions identified at Step S103 include portions of the two contour lines 411 and 412 that are opposed to each other in the swing direction of the needle bar 108. At Step S105, the CPU 61 calculates a distance Dc between the contour lines 411 and 412 in the area 98. For example, the CPU 61 may calculate the distance Dc between the two coordinates representing two points that are respectively located on the contour lines 411 and 412 along a line extending in the left-right direction and through the needle drop point 120. Because the coordinates of the needle drop point 120 are (0, 0), the CPU 61 extracts the two points on the contour lines 411 and 412 that are 0 on the Y-coordinate. In the present embodiment, the swing direction of the needle bar 108 is a direction parallel to the X-coordinate (i.e., the left-right direction). Thus, if the two points that are 0 on the Y-coordinate have coordinates (−2, 0) and (2, 0), for example, the distance Dc between the two points in this coordinate system is four (i.e., 2−(−2)=4). In this case, the CPU 61 can calculate the width Lw of the cord 41 immediately before forming one stitch.

At Step S107, the CPU 61 calculates the length of the cord 41 in the swing direction of the needle bar 108, as the width Lw of the cord 41, based on the distance Dc calculated at Step S105. For example, the CPU 61 multiplies the distance Dc by a width transformation coefficient Kw to calculate the width Lw of the cord 41. Each of the cord-absent image 321, the cord-present image 322 and the cord image 323 generated at Step S101 is converted to a virtual image which would be obtained when an image of the specified range including the presser foot 47 were taken from directly above. The distance between two different points within the needle opening 40 of the presser foot 47 is very small when compared to the distance between the image sensor 50 and the needle opening 40 of the presser foot 47. Therefore, the width Lw of the cord 41 varies linearly with respect to the distance Dc between arbitrary two coordinates in the needle opening 40 of the cord image 323. The width transformation coefficient Kw is a transformation coefficient between the distance Dc and the width Lw of the cord 41 that is defined beforehand. Thus, the CPU 61 can calculate the width Lw of the cord 41 using the Equation (1) below.

$$\text{Width } Lw = \text{Width Transformation Coefficient } Kw \times \text{Distance } Dc \quad (1)$$

For example, if the width transformation coefficient Kw is one and the distance Dc is four, then the width Lw of the cord 41 is 4 millimeters (i.e., 1×4=4 (mm)). The CPU 61 causes the RAM 63 to store the data representing the calculated width Lw of the cord 41. After Step S107, the CPU 61 finishes the cord width calculation processing (Step S31 in FIG. 8), and proceeds to Step S33.

At Step S33, the CPU 61 performs the height calculation processing. The height calculation processing is processing in which the CPU 61 calculates the height Ph of the presser foot 47 based on the width Lw of the cord 41 calculated at Step S31. The height Ph is a height to which the pressing face 421 of the presser foot 47 is raised from a position at which the pressing face 421 abuts on the flat surface 116 of the needle plate 115. In other words, the height Ph indicates the height position of the pressing face 421 of the presser foot 47 after the presser foot 47 is raised, with reference to the flat surface 116.

Figure 12:
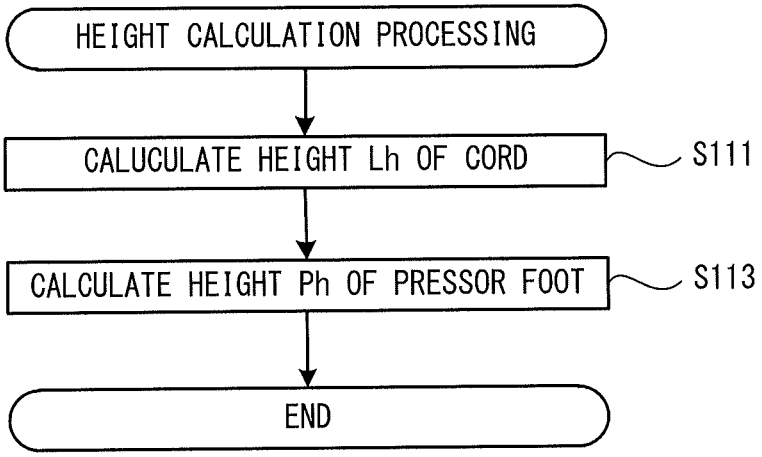
FIG. 12 shows a flowchart of height calculation processing.

Referring to FIG. 12, the height calculation processing (Step S33 in FIG. 8) will be described in detail. Upon starting the processing at Step S33, the CPU 61 proceeds to Step S111 shown in FIG. 12.

At Step S111, the CPU 61 calculates the height Lh of the cord 41 based on the width Lw of the cord 41 calculated at Step S31. The height Lh of the cord 41 is a length of the cord 41 in a direction substantially perpendicular to the flat surface 116 of the needle plate 115 (i.e., in the up-down direction). Specifically, in a case where the cord 41 is made from a hard material such that the cord 41 is not deformed by the pressing force of the presser foot 47, the CPU 61 may take the same length as the width Lw of the cord 41 calculated at Step S31, as the height Lh of the cord 41. For example, if the width Lw of the cord 41 is 4 millimeters, the height Lh of the cord 41 is 4 millimeters, which is equal to the width Lw of the cord 41.

At Step S113, the CPU 61 calculates the height Ph of the presser foot 47 based on the height Lh of the cord 41 calculated at Step S111. Specifically, the CPU 61 adds a specified height to the height Lh of the cord 41 calculated at Step S111 such that the height Ph of the presser foot 47 allows the pressing face 421 of the presser foot 47 to contact the upper end 415 of the cord 41, and allows the work cloth 99 and the cord 41 to move between the presser foot 47 and the needle plate 115. For example, the CPU 61 may calculate the height Ph of the presser foot 47 by adding the thickness Lc of the work cloth 99 detected by the potentiometer 88 to the height Lh of the cord 41. The CPU 61 causes the RAM 63 to store the calculated height Ph of the presser foot 47. After Step S113, the CPU 61 finishes the height calculation processing shown in FIG. 12, and proceeds to Step S35 shown in FIG. 8.

At Step S35, the CPU 61 determines whether or not the start/stop key 113 is depressed. In a case where the CPU 61 determines that the start/stop key 113 is depressed (Step S35: YES), the CPU 61 proceeds to Step S37. In a case where the CPU 61 determines that the start/stop key 113 is not depressed (Step S35: NO), the CPU 61 repeats Step S35.

At Step S37, the CPU 61 performs the sewing processing. The sewing processing is processing in which the sewing machine 100 sews the cord 41 onto the work cloth 99.

Figure 14:
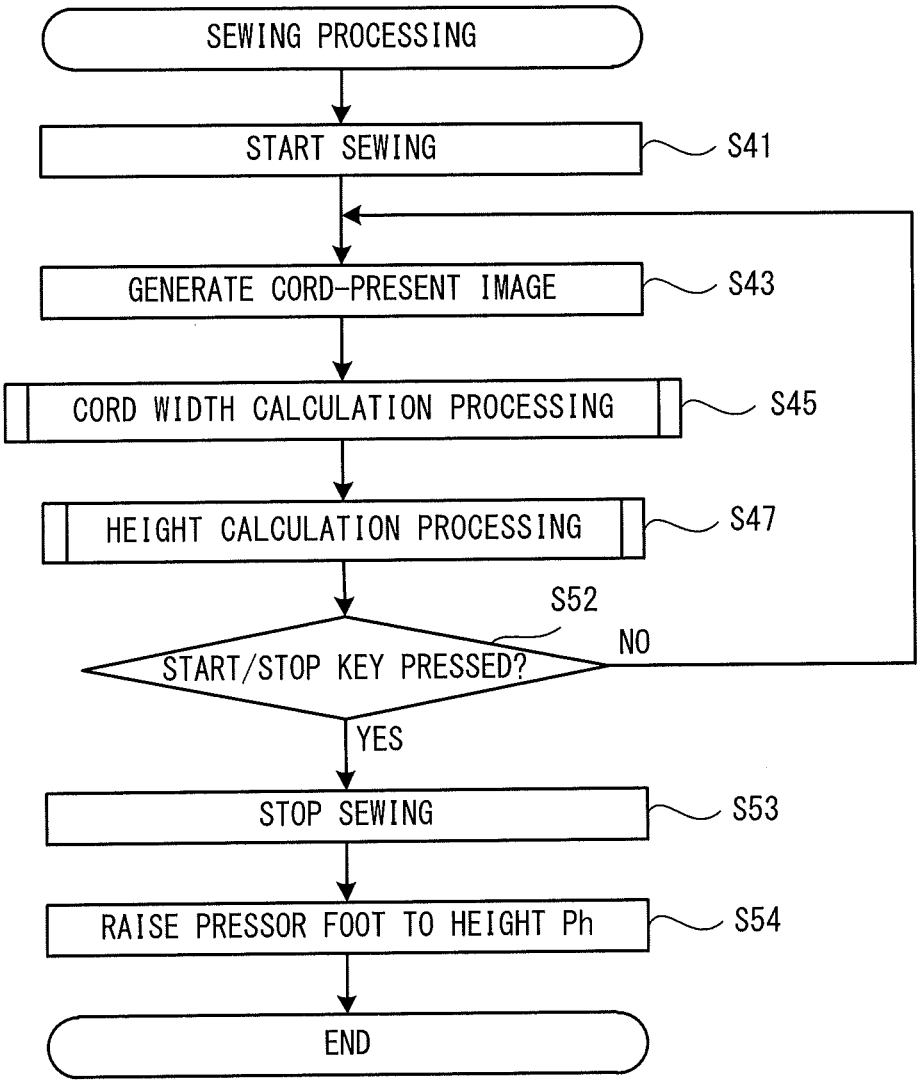
FIG. 14 shows a flowchart of sewing processing.

Referring to FIG. 14, the stitch process (Step S37 in FIG. 8) will be described in detail. Upon starting the processing of Step S37, the CPU 61 proceeds to Step S41 shown in FIG. 14.

At Step S41, the CPU 61 causes the sewing machine 100 to start sewing. Specifically, the CPU 61 sends a command via the drive circuit 72 to cause the drive shaft motor 79 to start rotating. In response to the start command, the drive shaft motor 79 starts rotating. As the drive shaft motor 79 rotates, the needle bar up-down drive mechanism causes the needle bar 108 to move up and down. Simultaneous to the up and down movements of the needle bar 108, the cloth feed mechanism is driven and the horizontal rotary shuttle is rotated. The CPU 61 also controls the swing motor 23 of the needle bar swing mechanism 15 via the drive circuit 74 such that the needle bar 108 is caused to swing with an appropriate swing width in synchronization with the up and down movements of the needle bar 108. The sewing machine 100 performs the above-described operations to sew the cord 41 onto the work cloth 99.

At Step S43, the CPU 61 instructs the image sensor 50 to captures an image, as in Step S29. In response to the image capture command, the image sensor 50 takes an image of the specified area including the presser foot 47 and the cord 41 guided by the presser foot 47. The CPU 61 stores the image data of the image, which is taken by the image sensor 50 at Step S43 and converted in the same manner as in Step S29, in the RAM 63 as the image data of the cord-present image 322.

The processing at Step S45 is similar to the above-described processing at Step S31, and therefore Step S45 will not be described here. The CPU 61 causes the RAM 63 to store the data representing the width Lw of the cord 41 calculated at Step S45.

At Step S47, the CPU 61 calculates the height Ph of the presser foot 47 based on the width Lw of the cord 41 calculated at Step S45 in the same manner as in Step S33. The CPU 61 causes the RAM 63 to store the data representing the height Ph of the presser foot 47 calculated at Step S47.

At Step S52, the CPU 61 determines whether or not the start/stop key 113 is depressed. In a case where the CPU 61 determines that the start/stop key 113 is depressed (Step S52: YES), the CPU 61 proceeds to Step S53. In a case where the CPU 61 determines that the start/stop key 113 is not depressed (Step S52: NO), the CPU 61 returns to Step S43. The CPU 61 repeats the processing of causing the image sensor 50 to capture an image and calculating the height Ph of the presser foot 47 based on the width Lw of the cord 41, until the start/stop key 113 is depressed (Steps S43 to S47).

At Step S53, the CPU 61 causes the sewing machine 100 to stop sewing. Specifically, the CPU 61 sends a command to the drive shaft motor 79 via the drive circuit 72 to stop the rotation of the drive shaft motor 79. In response to the stop command, the drive shaft motor 79 stops rotating.

Figure 13:
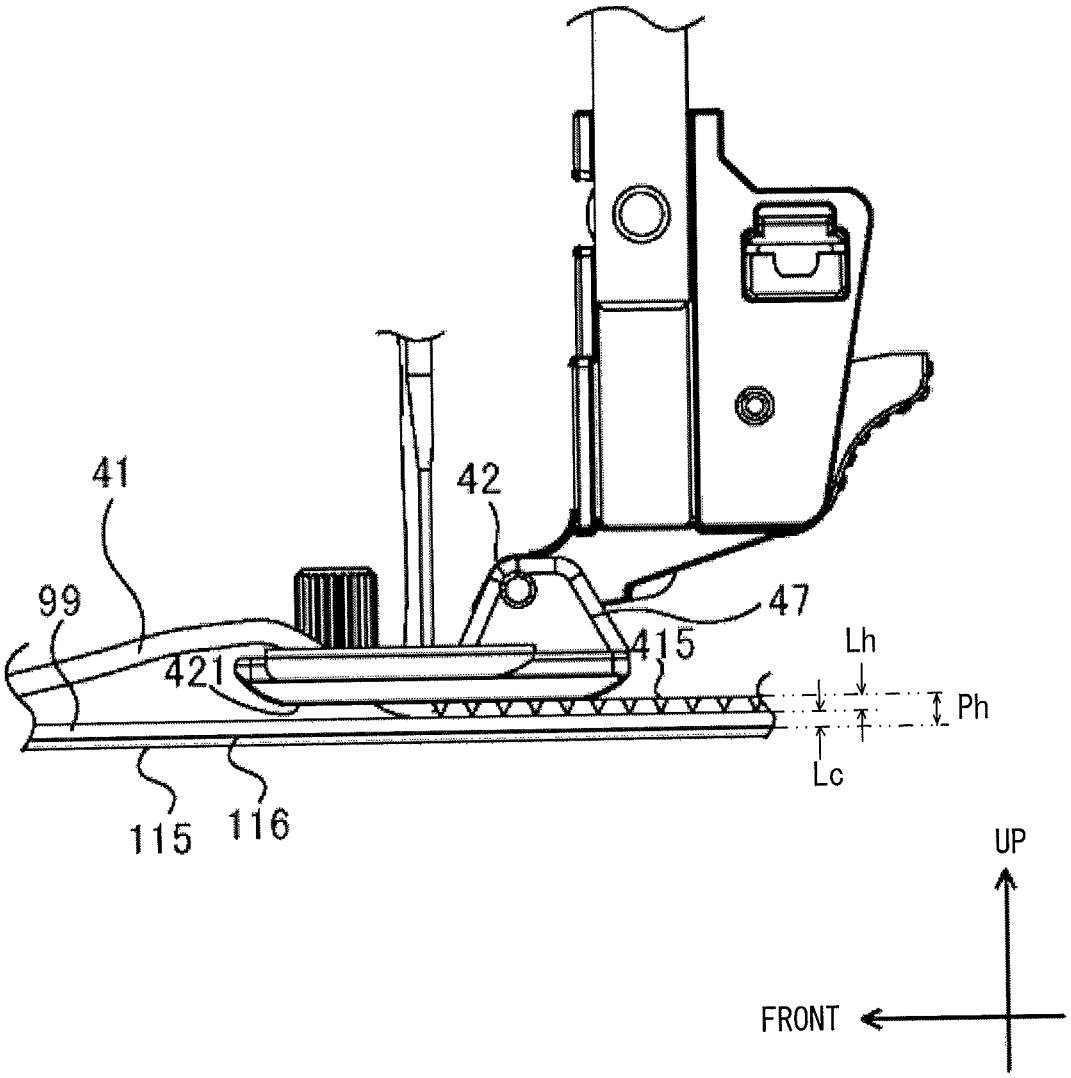
FIG. 13 is a right side view of a presser foot.

At Step S54, the CPU 61 controls the lift mechanism 80 to cause the presser foot 47 to be raised to the height Ph of the presser foot 47 calculated at Step S47, as shown in FIG. 13. Specifically, the CPU 61 sends a command via the drive circuit 76 to cause the lift motor 83 to start rotating such that the presser foot 47 moves up to the height Ph of the presser foot 47 calculated at Step S47. As the lift motor 83 rotates, the lift mechanism 80 causes the presser foot 47 to move up to the height Ph of the presser foot 47 calculated at Step S47. For example, if the height Lh of the cord 41 is 4 millimeters and the cloth thickness Lc is 1 millimeter, then the height Ph of the presser foot 47 is 5 millimeters (4+1=5 (mm)) During the sewing, the presser foot 47 is located 1 millimeter higher than the needle plate 115. 1 millimeter is the cloth thickness Lc. At Step S54, therefore, the lift mechanism 80 raises the presser foot 47 to a higher position by 4 millimeters. 4 millimeters is the height Lh of the cord 41. After Step S54, the CPU 61 finishes the sewing processing (Step S37 in FIG. 8) and completes the cording processing.

An image capture range of the image sensor 50 is fixed. Therefore, the area 98 corresponding to the inside of the needle opening 40, which is defined in accordance with the image capture range, is defined by specified coordinates in the cord image 323 produced from the cord-absent image 321 and the cord-present image 322 which are taken by the image sensor 50. The specified coordinates are stored in the ROM 62 beforehand. Accordingly, the CPU 61 can identify the area 98 corresponding to the needle opening 40 by simply reading the specified coordinates from the ROM 62.

The CPU 61 calculates the width Lw of the portion of the cord 41 which is present in the needle opening 40. Thus, the CPU 61 is able to calculate the width Lw of the cord 41 that is immediately before sewing. As a result, the sewing machine 100 can lift the presser foot 47 to the height Ph of the presser foot 47 that corresponds to the width Lw of the cord 41 immediately before sewing.

At Step S111, the CPU 61 takes the same length as the width Lw of the cord 41 calculated at Step S31, as the height Lh of the cord 41. In a case where the width Lw of the cord 41 does not change in the radial direction, i.e., in a case where the cross-sectional shape of the cord 41 is circular, the CPU 61 can calculate the height Ph of the cord 41 in a simple manner.

In a case where the pressing face 421 is sufficiently apart upward from the upper end 415 of the cord 41, i.e., the height Ph of the presser foot 47 is too high, more time may be needed to move the presser foot 47 up and down. In a case where the height Ph of the presser foot 47 is low to the extent that the pressing face 421 contacts the upper end 415 of the cord 41, and the work cloth 99 and the cord 41 cannot move between the presser foot 47 and the needle plate 115, the guide groove 242 of the presser foot 47 may be caught on the cord 41 and the work cloth 99 may not rotate smoothly. In the present embodiment, on the contrary, the CPU 61 sets the height Ph of the presser foot 47 at Step S113 such that the pressing face 421 only contacts the upper end 415 of the cord 41, and the work cloth 99 and the cord 41 can move between the presser foot 47 and the needle plate 115. Therefore, the CPU 61 can calculate an appropriate height Ph of the presser foot 47 that may allow the work cloth 99 to rotate smoothly, and reduce the time required for moving the presser foot 47 up and down.

At Step S113, the CPU 61 calculates the height Ph of the presser foot 47 by adding the thickness Lc of the work cloth 99 detected by the potentiometer 88 to the height Lh of the cord 41 calculated at Step S111. Thus, the CPU 61 can more accurately calculate an appropriate height Ph of the presser foot 47 that may allow the work cloth 99 to rotate smoothly, and reduce the time required for moving the presser foot 47 up and down.

Figure 15:
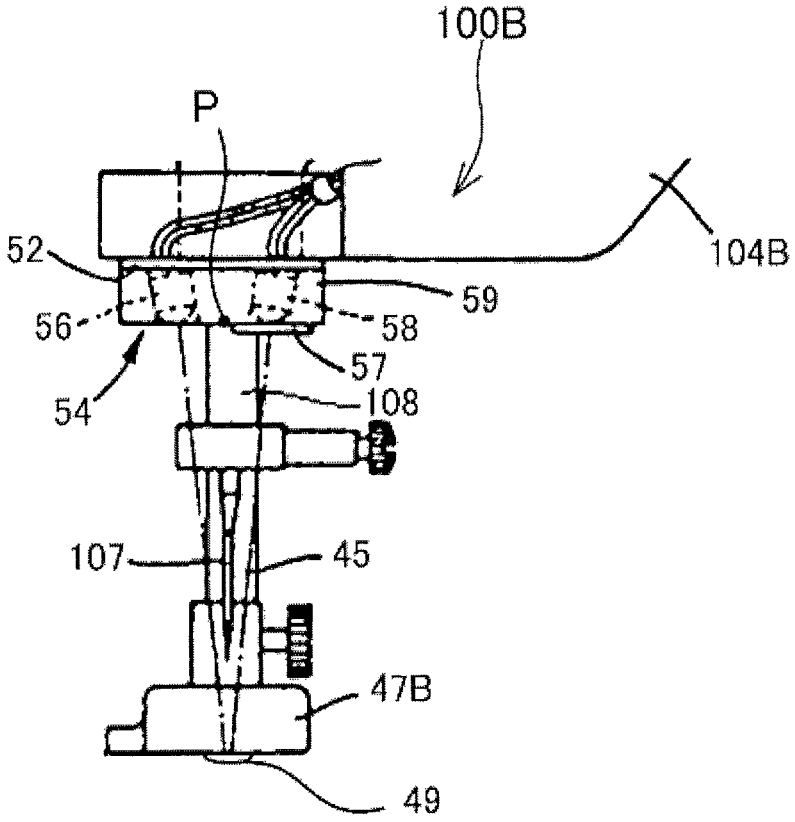
FIG. 15 is a front view of a head of a sewing machine according to another embodiment.
Figure 16:
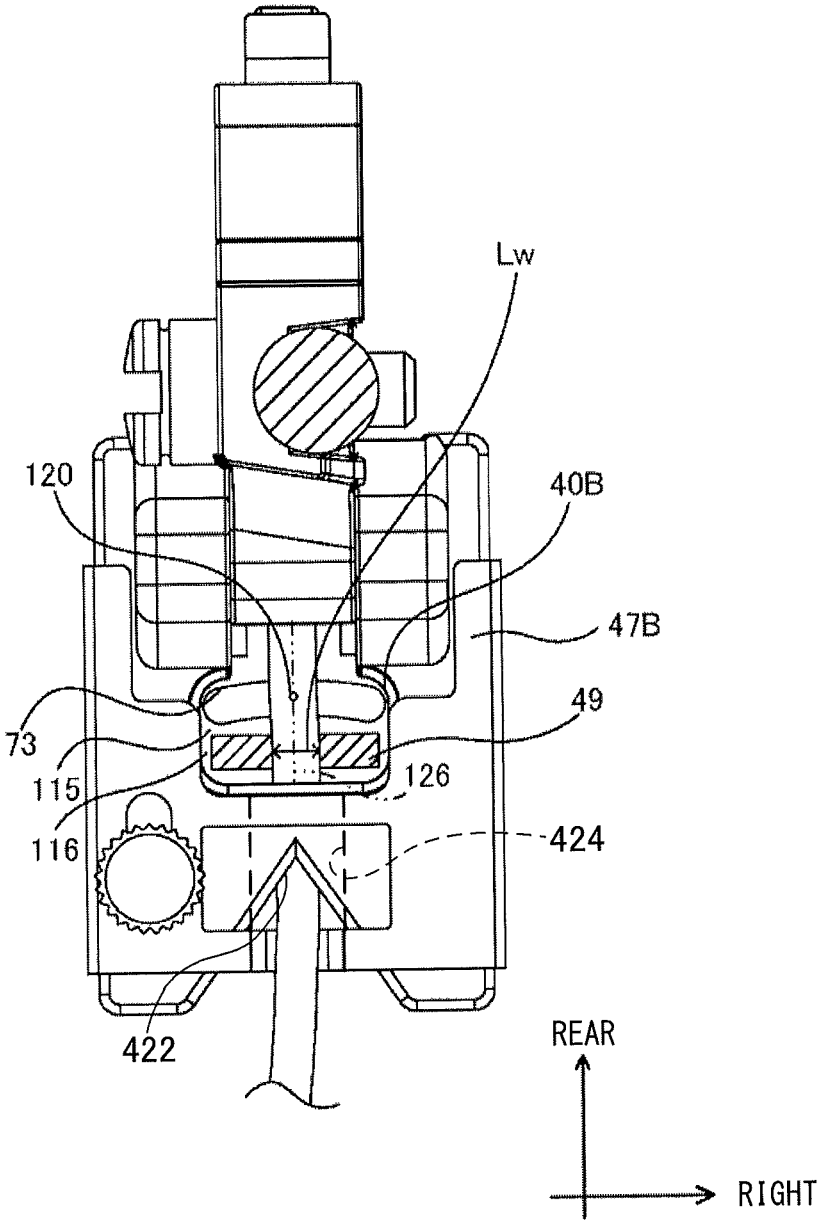
FIG. 16 is a plan view of a presser foot in the other embodiment.
Figure 17:
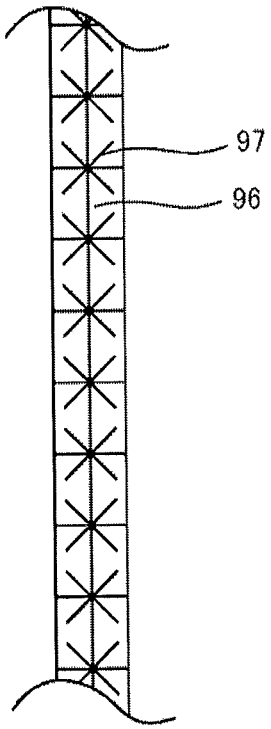
FIG. 17 shows an example of a cord having a decorative stitch formed thereon.

Referring to FIGS. 15 and 16, a structure of a sewing machine 100B according to another embodiment will be described. As shown in FIG. 15, the general structure of the sewing machine 100B is different from the sewing machine 100 of the above-described embodiment in that the sewing machine 100B includes a cord width detector 54 and a reflection plate 49, instead of the image sensor 50. In the following description, the same reference numerals and symbols are used for those components which are the same as the sewing machine 100, and such components will be omitted as appropriate.

Referring to FIG. 15, a head 104B of the sewing machine 100B will be described. The head 104B has a bracket 52 secured on a lower end portion of the head 104B, and the cord width detector 54 secured on the bracket 52. The cord width detector 54 includes a light emitting portion 56, a light receiving portion 58, a holder 59, a signal processing circuit (not shown), and an optical filter 57. The reflection plate 49 is provided on the needle plate 115. The light emitting portion 56 is provided on the head 104B, and is configured to emit infrared light toward the reflection plate 49 through the needle opening 40 of the presser foot 47. The light emitting portion 56 may be, for example, a photodiode. The light receiving portion 58 is provided on the head 104B, and is configured to receive the infrared light reflected by the reflection plate 49. It should be noted that when the cord 41 is set in the presser foot 47B, the light receiving portion 58 may receive the infrared light reflected by those portions of the reflection plate 49 which are not covered with the cord 41. The light receiving portion 58 may be, for example, a phototransistor. The holder 59 holds the light emitting portion 56 and the light receiving portion 58. The optical filter 57 is provided on a lower end portion of the light receiving portion 58 to cover a portion of the light receiving portion 58 which receives the light. The optical filter 57 is configured to allow the infrared light to pass therethrough, but to block light having other wavelengths. The signal processing circuit is configured to convert a quantity of light received at the light receiving portion 58 into a voltage, and to output the voltage. The CPU 61 is electrically connected to the cord width detector 54 via the input interface 65, and the CPU 61 can recognize the voltage output from the cord width detector 54.

Referring to FIG. 16, the presser foot 47B and the vicinity of the presser foot 47B will be described. The presser foot 47B is a cording foot, and has a generally similar structure to the presser foot 47 of the above-described embodiment. A through hole 73, through which the sewing needle 107 may pass, is formed in the needle plate 115. The reflection plate 49 is provided on a side of the guide groove 424 of the presser foot 47B with respect to the through hole 73 (i.e., provided on the front side of the through hole 73) in a direction perpendicular to the swing direction of the needle bar 108 and parallel to the flat surface 116 of the needle plate 115 (i.e., in the front-rear direction). The reflection plate 49 has a rectangular shape elongated in the left-right direction, when viewed from the top. The surface of the reflection plate 49 (more specifically, the upper surface thereof) is a reflection face. As shown in FIG. 14, the reflection face is a concave face defined by a circular arc with its center being the middle point P between the light emitting portion 56 and the light receiving portion 58. A straight line connecting the middle point P to an arbitrary point on the reflection plate 49 is orthogonal to the surface of the reflection plate 49. Therefore, the light emitted toward the reflection plate 49 from the light emitting portion 56 is reflected toward the light receiving portion 58. Because the light emitting portion 56 and the light receiving portion 58 are located to the front of the needle bar 108, the reflection face of the reflection plate 49 is slightly inclined downward toward the front side. Thus, the infrared light emitted from the light emitting portion 56 is reflected toward the light receiving portion 56.

The presser foot 47B has a needle opening 40B through which the sewing needle 107 may pass. The needle opening 40B opens above the reflection plate 49 and the through hole 73.

The cord width detector 54 (more specifically, the signal processing circuit) outputs a voltage that represents a quantity of the light received by the light receiving portion 58, as the data representing the shape of the cord 41. The CPU 61 calculates the width Lw of the cord 41 based on the output voltage. The cord 41 is guided toward the needle opening 40B by the guide groove 424 of the presser foot 47B along the direction that is parallel to the flat surface 116 of the needle plate 115 and perpendicular to the swing direction of the needle bar 108 (i.e., along the front-rear direction). Specifically, a portion of the cord 41, which is present in the needle opening 40B, extends along the center baseline 126 and left-right symmetrical with respect to the center baseline 126. Therefore, the width Lw of the cord 41, which has the center baseline 126 extending through its center of the width, linearly changes with the output voltage Vc that represents the quantity of the light received by the light receiving portion 58. For example, if the output voltage representing the quantity of light received by the receiving portion 58 when the reflection plate 49 is not covered by the cord 41 is expressed by Va and a voltage conversion coefficient is expressed by Kv, the output voltage Vc can be calculated by the following equation (2). The voltage conversion coefficient Kv is a coefficient used for conversion between the output voltage and the cord width Lw.

$$\text{Output Voltage } Vc = \text{Output Voltage } Va - \text{Voltage Conversion Coefficient } Kv \times \text{Width } Lw \text{ of Cord } 41 \quad (2)$$

The equation (3) below is derived from the equation (2).

$$\text{Width } Lw \text{ of Cord } 41 = (\text{Output Voltage } Va - \text{Output Voltage } Vc)/\text{Voltage Conversion Coefficient } Kv \quad (3)$$

If the output voltage Va is 5 volts, the output voltage Vc is 3 volts, and the voltage conversion coefficient Kv is 1 V/mm, the width Lw of the cord 41 is 2 millimeters ((5−3)/1=2 mm)

In the present embodiment, the cord 41 is situated along the center baseline 126 by the concaved portion 431 of the guide plate 43 and the guide groove 424 of the presser foot main body 42 such that the cord 41 is symmetrical with respect to the center baseline 126 in the swing direction. Thus, the CPU 61 can calculate the width Lw of the cord 41 based on the quantity of the infrared light that is emitted from the light emitting portion 56, reflected by the reflection plate 49, and received by the light receiving portion 58. As a result, the CPU 61 can calculate the width Lw of the cord 41 by performing relatively simple processing rather than performing complicated image processing on the image taken by the image sensor 50.

In the present embodiment, the reflection plate 49 is provided on the side of the guide groove 424 of the presser foot 47B with respect to the through hole 73, in a direction parallel to the flat surface 116 of the needle plate 115 and perpendicular to the swing direction of the needle bar 108 (i.e., in the front-rear direction). Thus, the cord 41 immediately prior to sewing is located on the reflection plate 49. Because the light receiving portion 58 receives the quantity of light corresponding to the width Lw of the cord 41 immediately prior to the sewing, the CPU 61 is able to calculate the width Lw of the cord 41 more accurately.

Various changes and modifications may be made to the above-described embodiments. The following description deals with some examples of such changes and modifications.

Each of the presser foots 47 and 47B is configured such that the guide groove 424 formed in the lower face of the presser foot main body 42 guides the cord 41 to the needle opening 40. It should be noted, however, that the structure of the cording foot is not limited to the one that is configured to guide the cord 41 with the lower face of the presser foot main body 42. The cording foot may be configured to guide the cord 41 to the needle opening 40, 40B with the upper face of the presser foot main body 42, as long as the cording foot can press the cord 41 against the needle plate 115. Such cording foot may be disclosed in, for example, Japanese Patent Application Laid-Open Publication No. 5-228284, relevant portions of which are incorporated herein by reference.

In the above-described embodiments, the CPU 61 controls the lift mechanism 80 at Step S54, in response to a fact that the start/stop key 113 is depressed at Step S52 in FIG. 14, and causes the presser foot 47 to be raised to the height Ph of the presser foot 47 calculated at Step S47. Alternatively, the CPU 61 may cause the presser foot 47 to be raised to the height Ph of the presser foot 47 in a case where the user depresses the presser foot lift key 118 after the user depresses the start/stop key 113 at Step S52.

In the above-described embodiments, the CPU 61 calculates the height Ph of the presser foot 47 by adding the thickness Lc of the work cloth 99 to the height Lh of the cord 41 at Step S113 in FIG. 12. The CPU 61 may calculate the height Ph by adding a set height, instead of the thickness Lc of the work cloth 99, to the height Lh of the cord 41. For example, the CPU 61 may cause the liquid crystal display 110 to display a height adjustment screen after calculating the width Lw of the cord 41 at Step S31 in FIG. 8. The height adjustment screen may include a message informing the height Ph of the presser foot 47, and a pair of plus key and minus key to alter the height Ph of the presser foot 47. The plus key and the minus key may be used to alter the set height, which will be added to or subtracted from the height Lh of the cord 41. The set height can be added or subtracted in the order of for example, 0.1 millimeter. The set height may be altered as the user depresses the plus key or the minus key. The CPU 61 may alter the height Ph of the presser foot 47 in accordance with the set height. Specifically, the CPU 61 may change the height Ph of the presser foot 47 to a value that is obtained by adding the set height to the height Lh of the cord 41. For example, if the height Lh of the cord 41 is 4.0 millimeters and the set height is 0.5 millimeters, the height Ph of the presser foot 47 is 4.5 millimeters (4.0+0.5=4.5 mm). Alternatively, the CPU 61 may add the set height to a value, which is obtained by adding the thickness Lc of the work cloth 99 to the height Lh of the cord 41, in order to calculate the height Ph of the presser foot 47.

In the sewing processing shown in FIG. 14, the processing at Steps S43 to S47 may be dispensed with. In other words, the CPU 61 may not necessarily generate the cord-present image 322 and may not necessarily re-calculate the width Lw of the cord 41 and the height Ph of the presser foot 47 during the sewing processing. In this case, the CPU 61 may continue the sewing until the start/stop key 113 is depressed. In a case where the start/stop key 113 is depressed (Step S52: YES), the CPU 61 may stop the sewing (Step S53). At the subsequent step (Step S54), the CPU 61 may cause the presser foot 47 to be raised to the height Ph calculated at Step S33 in FIG. 8.

In the sewing processing shown in FIG. 14, the CPU 61 calculates the height Ph of the presser foot 47 every time an image is captured. In this case, even if the width Lw of the cord 41 (i.e., the height Lh of the cord) changes during the sewing processing, the height Ph of the presser foot 47 may be promptly re-calculated in accordance with the change in the cord width Lw. Accordingly, the CPU 61 can cause the presser foot 47 to move up to the appropriate height Ph regardless of when the sewing is stopped. However, the CPU may calculate the height Ph of the presser foot 47 at specified time intervals, instead of calculating it every time an image is captured. The specified time interval may be, for example, one second. For instance, the sewing machine 100 may be equipped with a timer. The sewing machine 100 may not calculate the width Lw while repeatedly taking images, until the timer counts one second. Also, the sewing machine 100 may not change the height Ph and may continue sewing until the timer counts one second. Specifically, the CPU 61 may perform determination processing to determine whether or not the timer has counted one second. In a case where the CPU 61 determines that the timer has counted one second, the CPU 61 may calculate the width Lw of the cord 41 based on the cord-present image 322 produced from the captured image 320, which is captured immediately before the timer counted one second (Step S45). The CPU 61 may calculate the height Ph of the presser foot 47 (Step S47). In this case, the number of times that the CPU 61 performs the step of calculating the width Lw and the step of calculating the height Ph can be reduced as compared to the case where the CPU 61 calculates the height Ph every time an image is captured. Therefore, it is possible to reduce the load on the CPU 61 when performing the sewing processing.

The CPU 61 may calculate the height Ph of the presser foot 47 at Step S47 only when the width Lw of the cord 41 calculated at Step S45 in FIG. 14 is different from the width Lw calculated in the preceding processing. Specifically, the CPU 61 may cause the RAM 63 to store the newest width Lw and another width Lw calculated in the immediately preceding processing in the overwriting manner in this order every time the CPU 61 calculates the width Lw of the cord 41 at Step S45. The CPU 61 may execute a determination step to determine whether or not the two stored widths Lw are different from each other. In a case where the CPU 61 determines that the two widths Lw are different from each other, the CPU 61 may calculate the height Ph of the presser foot 47 based on the newest width Lw. In a case where the CPU 61 determines that the two widths Lw are the same, the CPU 61 may not calculate the height Ph of the presser foot 47. It should be noted that a certain error may be tolerated when it is determined whether or not "the two widths Lw are the same". The certain error or tolerance may be, for example, within a range between −0.1 millimeter and +0.1 millimeter. In this case, the number of times that the CPU 61 performs the step of calculating the height Ph of the presser foot 47 can be reduced as compared to the case where the CPU 61 calculates the height Ph of the presser foot 47 every time an image is captured. Accordingly, the CPU 61 can efficiently perform the sewing processing.

The CPU 61 may not necessarily generate the image data of the cord image 323 at Step S101 in FIG. 10. For example, in a case where the area 98 in which the cord 41 pressed by the presser foot 47 lies is within a region defined by specified coordinates of the cord-present image 322, then the CPU 61 may read the specified coordinates which are stored beforehand in the ROM 62. The CPU 61 may extract the area 98 from the cord-present image 322. The CPU 61 calculates the width Lw of the cord 41 based on the image of the cord 41 in the extracted area 98.

After the CPU 61 calculates the extending direction of the contour lines 411 and 412 at Step S105 in FIG. 10, the CPU 61 may calculate a distance between two points in the coordinate system in the direction perpendicular to the extending direction of the contour lines 411 and 412, and may calculate the width Lw of the cord 41 based on the distance between the two points in the coordinate system.

The above-described embodiments deal with the exemplary processing on the assumption that the cord 41 is made from a hard material. At Step S111, therefore, the CPU 61 takes the length equal to the width Lw of the cord 41 calculated at Step S31 as the height Lh of the cord 41. However, if the cord 41 is made from a soft material to the extent that the cord 41 is deformed by the pressing force of the presser foot 47, the width Lw of the pressed cord 41 is not equal to the height Lh of the cord 41. Specifically, the height Lh of the cord 41 is smaller than the width Lw of the cord 41. More specifically, it is considered that the height Lh of the cord 41 is reduced by an amount corresponding to an expanding amount of the cord 41 in the width direction upon pressing. It is also considered that a tightening force of the upper thread maintains the cord 41 in the expanding state, even when the pressing force is no longer exerted on the cord 41 by the presser foot 47. The ratio indicating the reduction in the height Lh of the cord 41 can be expressed by an inverse of the width Lw of the pressed cord 41 to the width Lw2 of the no-pressed cord 41. Therefore, if the width Lw2 of the no-pressed cord 41 is 3 millimeters and the width Lw of the pressed cord 41 is 4 millimeters, the height Lh of the cord 41 is 2.25 millimeters ($3\times(3/4)=2.25$ (mm)).

In the above-described embodiments, the zigzag stitch is used as an example of a stitch pattern with which the sewing machine 100 sews the cord 41 onto the work cloth 99. However, in a case where the cross section of the cord is not circular, the sewing machine 100 may sew a desired decorative stitch on the cord. As shown in FIG. 16, for example, in a case where the sewing machine 100 sews a decorative stitch 97 on a tape-shaped cord 96, the sewing machine 100 forms stitches of the decorative stitch 97 on the upper face of the cord 96, and therefore a swing width Lr should be smaller than the width Lw of the cord 96. In other words, unlike the zigzag stitch, the left needle drop point 124 and the right needle drop point 125 are situated inside the edges of the cord 96 in the swing direction of the needle bar 108 (in the left-right direction). It should also be noted that the cording processing may be applied not only to the zigzag stitch shown in FIG. 13 and the decorative stitch 97 shown in FIG. 16, but also to other stitches to be sewn on the work cloth 99 with the cord 41 while swinging the needle bar 108. It should also be noted that in a case where the cross-sectional shape of the cord is not circular, e.g., in a case where the cord has a tape shape, the width of the cord is not equal to the height of the cord, regardless of the cord being pressed or not. In this case, data representing the type of the cord (e.g., a cord with a cross-sectional shape of an oval, a tape-like cord, or the like) may be associated with data representing the ratio of the cord width to the cord height, and the data may be stored in, for example, the ROM 62 in advance. The CPU 61 may receive the entry of the selected kind of the cord together with the stitch pattern, for example, at Steps S15 to S17 in FIG. 8. The CPU 61 may refer to the data stored in the ROM 62, and may calculate the height Ph of the cord at Step S111 in FIG. 12 by multiplying the width Lw of the cord by the ratio corresponding to the selected kind of the cord.

The CPU 61 may calculate the width Lw of the cord 41 by means of any image processing other than the edge detection, as long as the distance between the opposite edges of the cord 41 in the swing direction can be calculated at Steps S103 and S105 in FIG. 10. Such image processing may be, for example, binarizing pixels of the cord image 323 such that pixels in which the cord 41 is not present are converted to 0 and pixels in which the cord 41 is present are converted to 1. After the binarization, the CPU 61 may calculate the distance Dc between the two points in the coordinate system, and calculate the width Lw of the cord 41 by counting how many 1 continues in the pixels in the swing direction extending through the needle drop point 120. Then, the CPU 61 may calculate the width Lw of the cord 41.

In the above-described embodiments, the CPU 61 executes the program data 210 stored in the ROM 62 to cause the sewing machines 100 and 100B to perform various functions. The CPU 61 may be identified as a control portion to realize the various functions which the sewing machines 100 and 100B possess. The program data 210 may be written in the ROM 62 when the sewing machines 100 and 100B are shipped from a factory. The ROM 62 is one example of a computer readable storage device. For example, an HDD or a RAM may be used, instead of the ROM 62, as the storage device. In this case, the storage device is a non-transitory storage medium. The non-transitory storage medium can store data regardless of the time length for storing the data. The program data 210 may be stored in other storage media such as an external server. If the program data 210 is stored in the external server or the like, the program data 210 may be downloaded from the external server or the like through a connection interface, and appropriately stored in the ROM 62, the HDD, the RAM or the like. In such case, the program data 210 may be transmitted to the sewing machines 100 and 100B in the form of transmission signals from the external server or the like, which is the computer readable transitory storage medium.

In the above-described embodiments, the step of calculating the width Lw of the cord 41, the step of calculating the height Ph of the presser foot 47, and the step of controlling the lift mechanism 80 to cause the presser foot 47 to be raised to the height Ph of the presser foot 47 are carried out as the CPU 61 executes the software (program data 210). It should be noted, however, that one or more of these steps may be carried out by hardware. Although the CPU 61 executes all of these steps in the above-described embodiments, another CPU may execute at least some part of the steps, or one or more ASICs (Application Specific Integrated Circuits) may execute at least some part of the steps.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a bed;

a needle plate provided on the bed and having a flat surface;

a needle bar configured to hold a sewing needle;

a needle bar swing mechanism configured to cause the needle bar to swing in a first direction;

a lift mechanism configured to raise and lower a presser foot, the presser foot including a needle opening, a guide portion and a pressing face, the needle opening being configured to allow the sewing needle to pass through the needle opening, the guide portion being configured to guide a cord toward the needle opening along a second direction, the second direction being generally parallel to the flat surface of the needle plate and generally perpendicular to the first direction, the pressing face being configured to be arranged to face the flat surface of the needle plate and press the needle plate, an optical detecting portion configured to optically detect the cord guided by the guide portion and to output data representing the cord; and a control portion configured to:

calculate a width of the cord based on the data output by the optical detecting portion, the width of the cord being a length of the cord in a third direction, the third direction being generally parallel to the flat surface of the needle plate and generally perpendicular to an extending direction of the cord, calculate a height position of the presser foot based on the width of the cord, the height position being a position of the pressing face relative to the flat surface in an up-down direction, and cause the lift mechanism to move the presser foot to the height position.

2. The sewing machine according to claim 1, wherein:

the optical detecting portion includes an image capturing portion, the image capturing portion being configured to capture an image of the cord guided by the presser foot, and to output data representing the image as the data representing the cord, and the calculating the width of the cord includes calculating the width of the cord based on the data representing the image output from the image capturing portion.

3. The sewing machine according to claim 2, wherein the calculating the width of the cord includes calculating the width of the cord based on a length, in the first direction, of a first portion of the cord in the image represented by the data, the first portion being a portion of the cord in the image which is present in a specified area, the specified area being an area defined in accordance with an image capture range of the image capturing portion and corresponding to an inside of the needle opening.

4. The sewing machine according to claim 3, wherein:

the control portion is further configured to extract, by image processing, a contour line of the first portion from an image of the first portion of the cord, and the calculating the width of the cord includes calculating the width of the cord based on a distance between two portions of the contour line, the two portions being opposed to each other in the first direction.

5. The sewing machine according to claim 1, wherein the calculating the height position includes:

calculating a height of the cord based on the width of the cord, the height of the cord being a length of the cord in a direction generally perpendicular to the flat surface, and calculating the height position of the presser foot based on the height of the cord.

6. The sewing machine according to claim 5, wherein the calculating the height of the cord includes calculating, as the height of the cord, a length that is equal to the width of the cord.

7. The sewing machine according to claim 5, wherein the calculating the height position includes calculating the height position of the presser foot by adding a specified height to the height of the cord.

8. The sewing machine according to claim 7, further comprising:

a cloth thickness detecting portion configured to output data representing a thickness of a work cloth placed on the needle plate, wherein the calculating the height position includes calculating the height position of the presser foot by adding the thickness represented by the data output from the cloth thickness detecting portion, as the specified height, to the height of the cord.

9. The sewing machine according to claim 1, wherein the optical detecting portion includes:

a reflection plate provided on the needle plate, the reflection plate being configured to reflect light, the reflection plate being located below the needle opening when the presser foot is attached to the sewing machine;

a light emitting portion provided on a head of the sewing machine, the light emitting portion being configured to emit the light toward the reflection plate;

a light receiving portion provided on the head, the light receiving portion being configured to receive the light reflected by the reflection plate; and an output portion configured to output data representing a quantity of light received by the light receiving portion, as the data representing the cord, and wherein the calculating the width of the cord includes calculating the width of the cord based on the data representing the quantity of the light output by the output portion.

10. The sewing machine according to claim 9, wherein:

the needle plate has a through hole configured to allow the sewing needle to pass through the through hole, and the reflection plate is located, in the second direction, on a side of the guide portion with respect to the through hole when the presser foot is attached to the sewing machine.

11. A non-transitory computer readable medium configured to store computer readable instructions executable by a computer of a sewing machine, the sewing machine comprising a bed, a needle plate provided on the bed and having a flat surface, a needle bar configured to hold a sewing needle, a needle bar swing mechanism configured to swing the needle bar in a first direction, and a lift mechanism configured to raise and lower a presser foot, the presser foot including a needle opening, a guide portion, and a pressing face, the needle opening being configured to allow the sewing needle to pass through the needle opening, the guide portion being configured to guide a cord toward the needle opening along a second direction, the second direction being a direction generally parallel to the flat surface of the needle plate and generally perpendicular to the first direction, the pressing face being configured to be arranged to face the flat surface of the needle plate and press the needle plate, the computer readable instructions, when executed, causing the sewing machine to:

calculate a width of the cord based on data output by an optical detecting portion of the sewing machine, the optical detecting portion being configured to optically detect the cord guided by the guide portion, the width of the cord being a length of the cord in a third direction, the third direction being generally parallel to the flat surface of the needle plate and generally perpendicular to an extending direction of the cord, calculate a height position of the presser foot based on the width of the cord, the height position being a position of the pressing face relative to the flat surface in an up-down direction, and cause the lift mechanism to move the presser foot to the height position.

12. The computer readable medium according to claim 11, wherein:

the optical detecting portion includes am image capturing portion, the image capturing portion being configured to capture an image of the cord guided by the presser foot, and to output data representing the image as the data representing the cord, and the calculating the width of the cord includes calculating the width of the cord based on the data representing the image output from the image capturing portion.

13. The computer readable medium according to claim 12, wherein the calculating the width of the cord includes calculating the width of the cord based on a length, in the first direction, of a first portion of the cord in the image represented by the data, the first portion being a portion of the cord in the image which is present in a specified area, the specified area being an area defined in accordance with an image capture range of the image capturing portion and corresponding to an inside of the needle opening.

14. The computer readable medium according to claim 13, wherein:

when executed, the computer readable instructions further cause the sewing machine to extract, by image processing, a contour line of the first portion from an image of the first portion of the cord, and the calculating the width of the cord includes calculating the width of the cord based on a distance between two portions of the contour line, the two portions being opposed to each other in the first direction.

15. The computer readable medium according to claim 11, wherein the calculating the height position includes:

calculating a height of the cord based on the width of the cord, the height of the cord being a length of the cord in a direction generally perpendicular to the flat surface, and calculating the height position of the presser foot based on the height of the cord.

16. The computer readable medium according to claim 15, wherein the calculating the height of the cord includes calculating, as the height of the cord, a length that is equal to the width of the cord.

17. The computer readable medium according to claim 15, wherein the calculating the height position includes calculating the height position of the presser foot by adding a specified height to the height of the cord.

18. The computer readable medium according to claim 17, wherein:

the sewing machine further includes a cloth thickness detecting portion configured to output data representing a thickness of a work cloth placed on the needle plate, and the calculating the height position includes calculating the height position of the presser foot by adding the thickness represented by the data output from the cloth thickness detecting portion, as the specified height, to the height of the cord.

19. The computer readable medium according to claim 11, wherein the optical detecting portion includes:

a reflection plate provided on the needle plate, the reflection plate being configured to reflect light, the reflection plate being located below the needle opening when the presser foot is attached to the sewing machine;

a light emitting portion provided on a head of the sewing machine, the light emitting portion being configured to emit the light toward the reflection plate;

a light receiving portion provided on the head, the light receiving portion being configured to receive the light reflected by the reflection plate; and an output portion configured to output data representing a quantity of light received by the light receiving portion, as the data representing the cord, and wherein the calculating the width of the cord includes calculating the width of the cord based on the data representing the quantity of the light output by the output portion.

20. The computer readable medium according to claim 19, wherein:

the needle plate has a through hole configured to allow the sewing needle to pass through the through hole, and the reflection plate is located, in the second direction, on a side of the guide portion with respect to the through hole when the presser foot is attached to the sewing machine.

* * * * *